US006133558A

United States Patent [19]

Ueda et al.

[11] Patent Number: 6,133,558

[45] Date of Patent: Oct. 17, 2000

[54] MICROWAVE STEAM HEATER WITH MICROWAVE AND STEAM GENERATORS CONTROLLED TO EQUALIZE WORKPIECE INNER AND SURFACE TEMPERATURES

[75] Inventors: Shigeki Ueda, Yamatokoriyama; Kazumi Hirai, Nabari; Fumiko Mori, Osaka; Ikuhiro Inada, Yamatokoriyama; Satomi Uchiyama, Nara, all of Japan

[73] Assignee: Matsushita Electric Industrial Co., Ltd., Japan

[21] Appl. No.: 08/983,641

[22] PCT Filed: Jun. 24, 1996

[86] PCT No.: PCT/JP96/01736

§ 371 Date: Apr. 6, 1998

§ 102(e) Date: Apr. 6, 1998

[87] PCT Pub. No.: WO97/01065

PCT Pub. Date: Jan. 9, 1997

[51] Int. Cl.[7] ..... H05B 6/50

[52] U.S. Cl. ..... 219/682; 219/710

[58] Field of Search ..... 219/681, 682, 219/683, 710, 711, 400, 401, 483, 448, 449, 497, 501

[56] References Cited

U.S. PATENT DOCUMENTS

| | | | |
|---|---|---|---|
| 4,376,131 | 3/1983 | Mori et al. | 426/231 |
| 4,705,927 | 11/1987 | Levendusky et al. | 219/10.55 M |
| 4,851,644 | 7/1989 | Oslin et al. | 219/400 |
| 4,924,072 | 5/1990 | Oslin et al. | 219/401 |
| 5,026,957 | 6/1991 | Pralus | 219/10.55 M |
| 5,319,171 | 6/1994 | Tazawa et al. | 219/705 |
| 5,360,965 | 11/1994 | Ishii et al. | 219/705 |
| 5,369,253 | 11/1994 | Kuwata et al. | 219/707 |
| 5,491,323 | 2/1996 | Mori et al. | 219/710 |
| 5,525,782 | 6/1996 | Yoneno et al. | 219/682 |
| 5,558,797 | 9/1996 | Tagagi et al. | 219/705 |
| 5,681,496 | 10/1997 | Brownlow et al. | 219/707 |
| 5,689,060 | 11/1997 | Matsushima et al. | 73/24.04 |
| 5,786,577 | 7/1998 | Han et al. | 219/682 |

FOREIGN PATENT DOCUMENTS

| | | |
|---|---|---|
| 0616487A1 | of 0000 | European Pat. Off. . |
| 63-273731 | 11/1988 | Japan . |
| 3-69481 | 3/1991 | Japan . |
| 4-82517 | 3/1992 | Japan . |
| 4-123790 | 4/1992 | Japan . |
| 6-241463 | 8/1994 | Japan . |
| 6-272866 | 9/1994 | Japan . |

*Primary Examiner*—Teresa J. Walberg
*Assistant Examiner*—Jeffrey Pwu
*Attorney, Agent, or Firm*—Rossi & Associates

[57] ABSTRACT

The present invention is aimed to offer a microwave heating apparatus which heats varieties of heating objects without affecting the excellent property, by introducing a means to control the environment surrounding a heating object. For implementing the objective, the heating apparatus comprises a heating cavity for housing an object of heating, a microwave generating means for irradiating microwave to said object of heating, a steam generating means for supplying steam to said heating cavity, and a control means for controlling said microwave generating means and said steam generating means so that inner temperature and surface temperature of said object of heating are approximately equal.

18 Claims, 21 Drawing Sheets

MICROWAVE STEAM HEATER WITH MICROWAVE AND STEAM GENERATORS CONTROLLED TO EQUALIZE WORKPIECE INNER AND SURFACE TEMPERATURES

TECHNICAL FIELD

The present invention relates to a microwave heating apparatus for heating/cooking various heating objects in an appropriate environment.

BACKGROUND ART

As a prior art of microwave heating apparatus, a thawing/cooking oven as disclosed in the Japanese Patent Publication No. Sho 55-51541 is well known. Referring to FIG. 23, a prior art thawing/cooking oven comprises a stirrer 3 disposed at the ceiling 2 of a sealable oven body 1, and a magnetron irradiation port 4 disposed in the neighbourhood of the stirrer. Within oven body 1, a detachable food shelf 5 is provided; a detachable liquid tray 6 for water, oil, etc. is provided underneath, in which a foodstuff A may be immersed when necessary; further beneath the tray, a heating means 7 by gas, electricity, etc. is provided. Through a combined work of magnetron irradiation port 4, liquid tray 6 and heating means 7, a heating object is heated with the magnetron irradiation from the above, and at the same time, depending on needs, with steam from boiling water from the underneath.

By the combined use of magnetron irradiation and heating with steam, the time for passing through the zone of maximum ice crystal formation, during which the cell wall is damaged when a frozen foodstuff is thawed, is minimized, and a foodstuff is thawed evenly without allowing escaping of delicious contents. Since water vapour is available, the oven may be used also for thawing frozen breads/frozen cakes, or treating the whole process steps of bread/cake making with fermentation.

Besides heating with steam, the oven is capable of conducting various heating/cooking processes. For example, thawing of frozen pre-processed foodstuffs in fat provided in the liquid tray, thawing of a frozen food package by a combined use of magnetron irradiation and hot air from a heating apparatus (hot air stirred by stirrer in the ceiling), and other cooking methods are disclosed.

In a prior art microwave heating apparatus, however, since the atmosphere in the heating cavity is approximately 100° C. temperature/100% humidity, drawbacks occur such as: when a frozen baked bread or a frozen fried tempura is thawed the surface becomes sticky with steam, affecting the taste; uneven temperature spread is readily caused between the inside and the surface of a foodstuff, which, in a case of thawing frozen breads where the water content is low, gives damage on the stuff affecting the flavor, elasticity or the feeling on teeth.

The issue is explained more in detail. FIG. 24 illustrates the changing temperature of a foodstuff and the oven cavity in a prior art oven wherein the heating with microwave and the heating with steam are conducted at a same time. The temperature of a foodstuff, starting from the frozen temperature (−20° C.), climbs up passing through the zone of maximum ice crystal formation (−1–−5° C.) where it consumes a great energy, taking some time there. While a foodstuff is in frozen state it does not absorb the microwave efficiently, instead the microwave goes deep into the foodstuff, and the heat is conducted swiftly. Consequently, the temperature within a foodstuff is relatively even. Application of steam helps the foodstuff quickly pass through the zone of maximum ice crystal formation, but the temperature within the heating cavity becomes approximately 100° C., and the humidity also approximately 100%.

After passing through the zone of maximum ice crystal formation, a foodstuff carries with it those places already thawed and those still frozen. The thawed parts show a dielectric loss several times to several tens of times as large, and microwave is selectively absorbed, which invites uneven temperature within a foodstuff. Especially when steam is applied, the surface of a foodstuff gathers steam, and only a superficial surface of foodstuff is heated by microwave, which expedite the increase of surface temperature. Namely, when the inside temperature of a foodstuff reaches an optimum level, the surface temperature is already far higher than the optimum.

The optimum temperature for a meal is different depending on the kind; it is higher than 80° C. for e.g. steamed meals; 60–70° C. for tempuras, if too hot the food material dehydrates, and moisture is deprived of by coating and taste is affected. The optimum temperature for breads is the room temperature or a temperature slightly higher than bodily temperature; if it is too high the stuff gets damage, and the flavor, elasticity and feeling on teeth are affected. Anyway, the the optimum temperature is at least lower than 90° C.

Also the optimum humidity for a meal is different depending on the kind. For example, the taste deteriorates with both breads and tempuras if their surface get moistened.

As described above, in a prior art microwave heating apparatus, the emphasis has been placed on how swiftly having a heating object pass through the zone of maximum ice crystal formation, while hardly any attention has been paid on how to heat/cook a foodstuff in an environment that is ideal for the foodstuff. Namely, when steam is provided the environment in heating cavity is made to be always at almost 100° C. temperature and approximately 100% humidity, therefore a foodstuff has never been heated/cooked in optimum environment.

DISCLOSURE OF THE INVENTION

The present invention is aimed at solving the above described drawbacks and is intended to heat/cook varieties of heating objects to an excellent condition by introducing a means to appropriately control, for example, the temperature, humidity, mode of air flow, etc.

According to the present invention disclosed, a means to control the environment surrounding a foodstuff or other heating object is introduced for controlling the atmosphere within a heating cavity to be almost identical to those temperature, humidity, etc. which are ideal for a heated/cooked foodstuff. By so doing, the surface temperature and the inner temperature of a foodstuff are kept almost equal, thereby a foodstuff under heating procedure is not deprived of, or supplied with too much heat or humidity, which enables the heating/cooking in a most suitable environment.

For implementing a further better heating operation, a method according to the present invention varies output of microwave in accordance with the condition of heating object during heating, for controlling profile of temperature increase of the heating object. By so doing, condition of a foodstuff, or a heating object is adapted to the enviroment within heating cavity, and a foodstuff is heated at an appropriate temperature without losing much humidity.

Further, according to the present invention, the atmosphere of heating cavity is directly watched, to be fed back to a control means. This ensures a reliable control of the environment within heating cavity.

BEST MODE FOR CARRYING OUT THE INVENTION (embodiment 1)

A first embodiment of the present invention is described hereunder referring to drawings.

Figure 2:
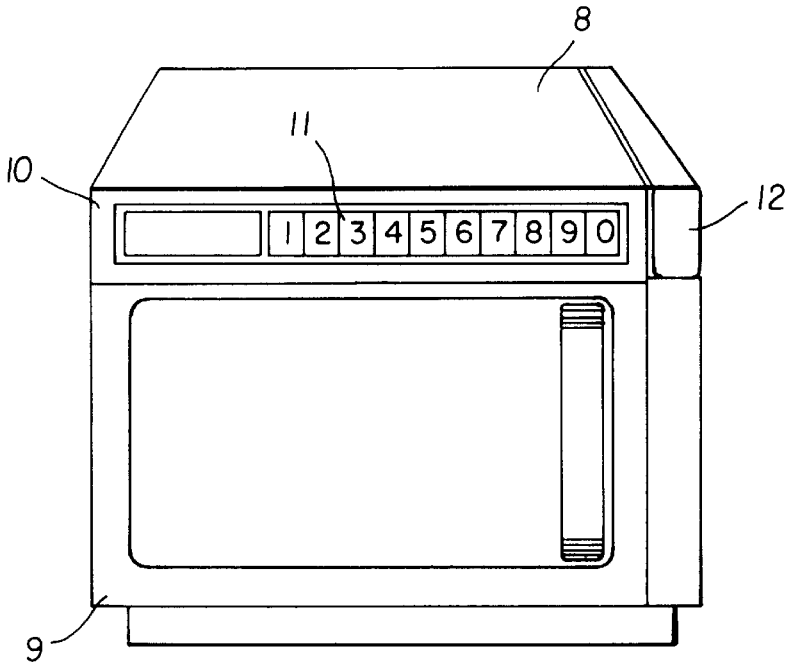
FIG. 2 shows appearance of a microwave heating apparatus according to the present invention.

FIG. 2 shows appearance of a heating apparatus implementing a method of heating foodstuff according to the present invention. In the front of oven body 8 is a door 9 disposed openable by hinge for closing the heating cavity in which a foodstuff is to be housed. On a operation board 10, a heating instruction key 11, or an input means, is disposed for entering instructions to a control section to be described later; the instructions are comprised of one-digit or two-digit code corresponding to such factors as category and quantity of foodstuff, store temperature (frozen or chilled), heat-end temperature, etc. which are relevant to method of heating. A water reservoir 12 is disposed detachable at the right side of body.

Figure 3:
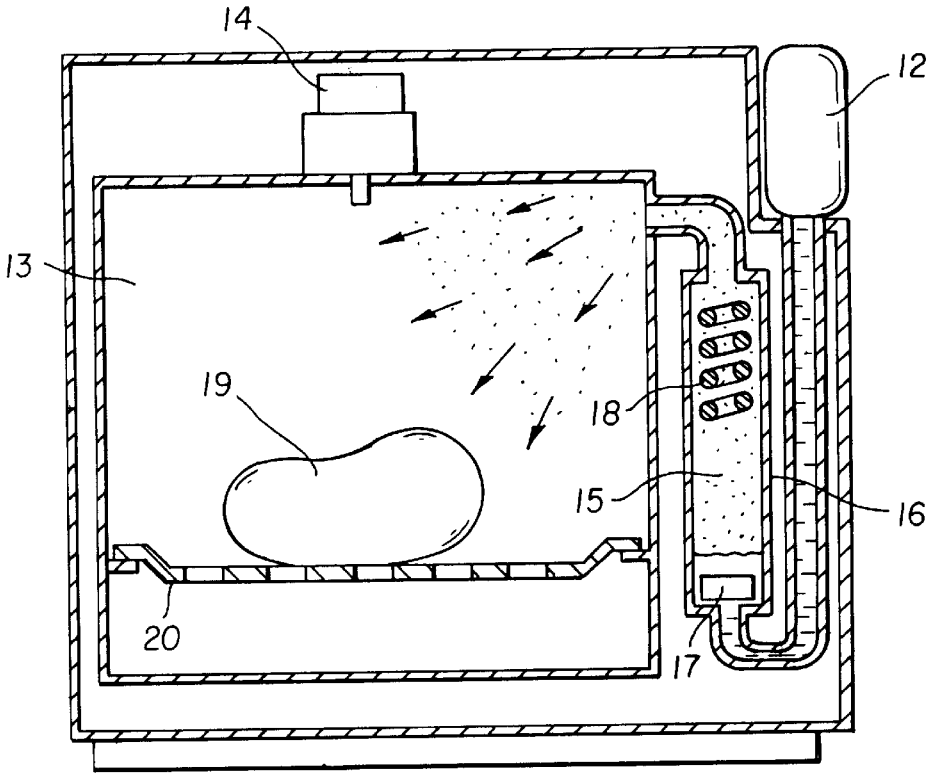
FIG. 3 shows cross sectional front view of a microwave heating apparatus according to a first embodiment of the present invention.

FIG. 3 shows cross sectional front view of heating cavity; a magnetron 14, or microwave generating means for irradiating microwave and a steam generator 15 for generating steam are coupled to heating cavity 13. Magnetron and said steam generator are controlled by a control section 21, operation of which is described later. Steam generator 15 comprises a boiler 16, atomizer 17 comprising an ultrasonic vibrator, and a temperature control heater 18, and turns water supplied from water reservoir 12 to boiler 16 into small particles of water at atomizer 17, and temperature control heater heats the small particles of water to a specified temperature. Under the controlled operation of atomizer 17 and controlled input to temperature control heater 18, steam generator 15 produces an air of desired temperature and humidity. A foodstuff 19 is placed on a tray 20 having various small holes or slits.

Figure 4:
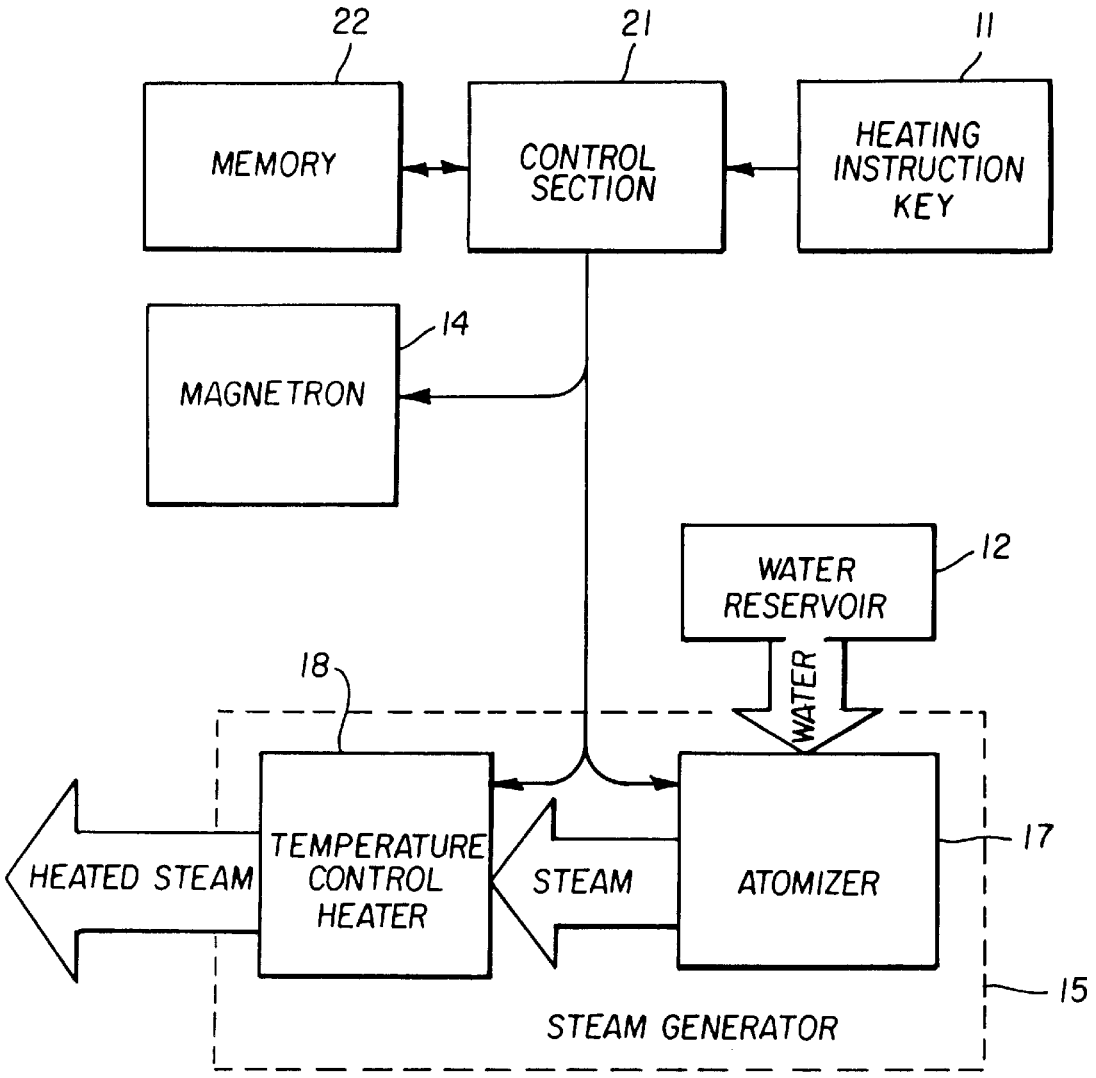
FIG. 4 is block diagram showing a constitution for controlling the environment within heating cavity of a microwave heating apparatus according to a first embodiment.

FIG. 4 is block diagram showing a constitution of control system; control section 21, or a means to control the environment, reads out a designated heating condition from a memory 22 upon receiving an instruction entered at heating instruction key 11. Control data for steam generator 15, viz. data of operation control of atomizer 17 and input control of temperature control heater 18, and data of power supply conditions to magnetron 14 are stored as the heating conditions. These data may either be a time sequential control value for each respective block, or a certain mathematical formula. In a case it is a mathematical formula, control section 21 conducts an operation to obtain time sequential data, and power supplies to atomizer 17, temperature control heater 18 and magnetron 14 are controlled according to the time sequential data; thus temperature/humidity of steam to be supplied to heating cavity as well as temperature of the foodstuff are controlled to an already designated mode along with the progress of heating procedure.

Figure 1A:
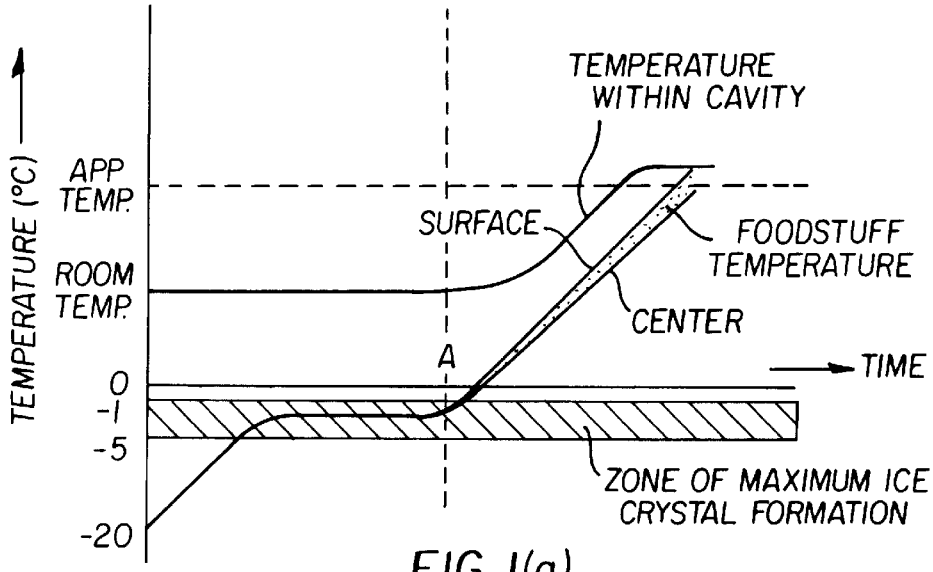
FIG. 1 illustrates a method of controlling the environment within heating cavity of a microwave heating apparatus according to a first embodiment.
Figure 1B:
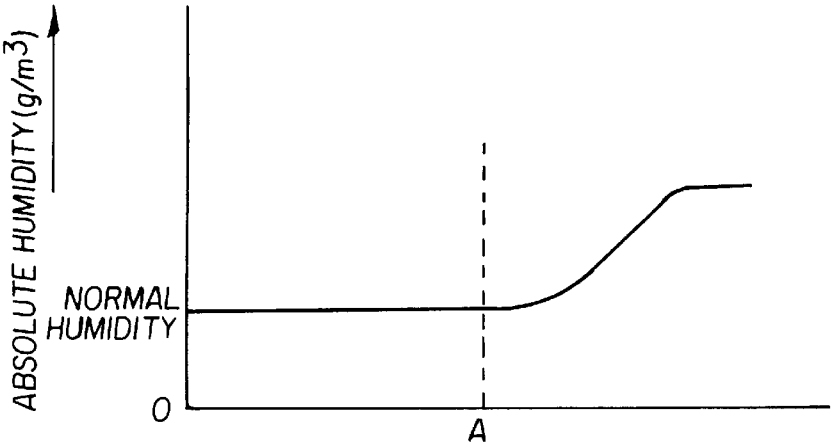
Figure 1C:
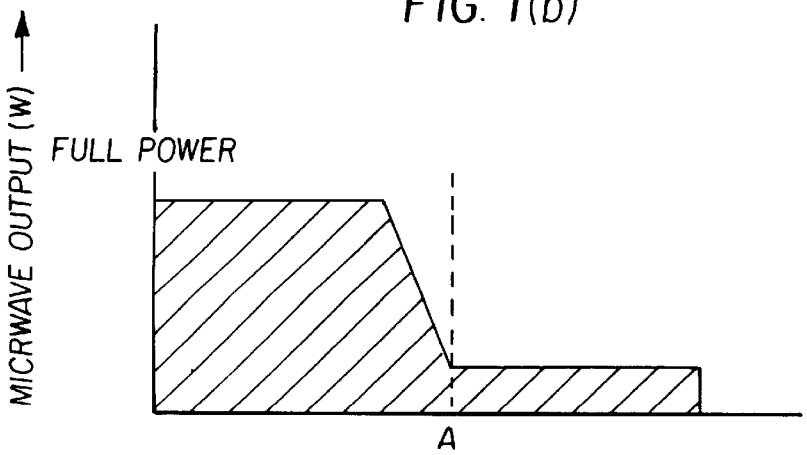

In FIG. 1 which illustrates the present invention, (a) shows temperature within heating cavity and temperature of foodstuff during heating procedure, (b) transition of humidity within the heating cavity, and (c) microwave output. What is significant with the present invention is that even when steam generating means is put into operation and heating is conducted with steam, the environment within heating cavity is not fixed in a constant state of approximately 100° C. temperature/approximately 100% humidity.

In other words, since control section 21 controls the microwave output and the steam generator, an apparatus according to the present invention cooks foodstuff always under an environment most suitable to the foodstuff.

Now in the following, a practical heating method is described. As indicated in (a), the temperature of a foodstuff started from the freezing temperature(−20° C.) passes through the zone of maximum ice crystal formation(−1−−5° C.) taking some lapse of time (point A). Since the foodstuff absorbs microwave only slightly and has a good internal heat conduction, the microwave is generated at full power to be irradiated to the foodstuff during the first half of heating, and then in the second half when part of the foodstuff starts melting the output is decreased to an appropriate level, as shown in (c). During the above thawing period, the temperature within heating cavity is maintained at the room temperature or slightly higher than that, and the humidity at a normal humidity or slightly higher, as shown in (b). Namely, thawing is conducted mainly with microwave which goes deep into a foodstuff in frozen state, while the use of steam is suppressed.

After passing the point A, the foodstuff in which melted part and frozen part coexist starts absorbing microwave significantly. As described earlier, the melted part(water) shows a dielectric loss several to several tens of times as high as that of frozen part, therefore the microwave output is reduced to a level about one fifth or sixth of the full power, as shown in (c). The temperature and humidity within heating cavity are raised after the point A or its vicinity, as shown in (a) and (b). When, the temperature within heating cavity is controlled, along with the progress of heating procedure, to keep almost an identical temperature as that of the foodstuff. Because thermal capacity of the air is low and foodstuff is quickly heated by microwave, it is efficient to set temperature of the environment at slightly higher, as shown in the drawing. Upon receiving a code entered from heating instruction key, the control section searches the memory and reads out control data corresponding to the category and quantity of foodstuff, store temperature(frozen or chilled, etc.), heat-end temperature, and other items; and executes the control from time to time on steam generator and magnetron in accordance with these control data. In order to provide a heating object after being thawed with humidity, an appropriate steam is supplied from steam generator, taking the humidity that a just-baked bread has into consideration. Thus, according to the present invention a foodstuff is not heated in an environment, approximately 100° C. temperature/approximately 100% humidity when hot steam is provided, under which prior arts conducted heating.

By the execution of such controls, the difference between the foodstuff itself and the environment surrounding it is reduced to minimum, under which situation the exchange of temperature and moisture(water) is difficult to occur. Namely, when an average temperature in the core of foodstuff reaches an appropriate level, the environmental temperature too is almost on an equal level, therefore thermal exchange and transfer of moisture at the surface of foodstuff is difficult to take place. Consequently, a bread an ideal temperature of which is the room temperature or a temperature slightly higher than bodily temperature does not get any material harm on the stuff because of very small in/out temperature difference; and a frozen bread may be thawed maintaining the same flavor and elasticity as it had when it was just baked and preserved until just before it was frozen, to an excellent condition, and the feeling to teeth is made to be comparable to the state as it was just baked. As the result, heating/cooking process proceeds keeping the surface temperature and the inner temperature of a foodstuff approximately equal, as shown in FIG. 1.

Since the humidity within heating cavity is optimized taking the moisture contained in a just-baked bread into consideration, the skin of bread does not absorb excessive moisture from steam.

In a case of tempura, because at the time when temperature of inner stuff reaches at 60–70° C. the coating is also heated approximately to the same temperature, the inner stuff is not deprived of moisture by the coating and keeps juicy state.

In the present embodiment, the surface of both bread and tempura is somewhat moisturous when heating is ended due to influence of steam but it dries up crisp in several minutes, before the dishes are carried to a dining table. In the repeated experiments, those by the present embodiment produced more crispy state in several minutes after heating is finished, as compared with those heated with only microwave. The reason seems to be that: when a heated foodstuff is taken out of heating cavity to a normal room ambient where it is dry and low in temperature it loses heat and moisture, therefore by providing in advance a slight moisture corresponding to a quantity to be lost to the surface of foodstuff it resumes a just-cooked state in several minutes. On the other hand, those heated with only microwave got increasingly moisturous in the coating after the heating is ended. The reason seems to be that: since the temperature of inner stuff is higher than that of coating, the moisture of inner stuff moves to the coating, rendering the coating moisturous, and the inner stuff suffers dehydration.

(embodiment 2)

Figure 5:
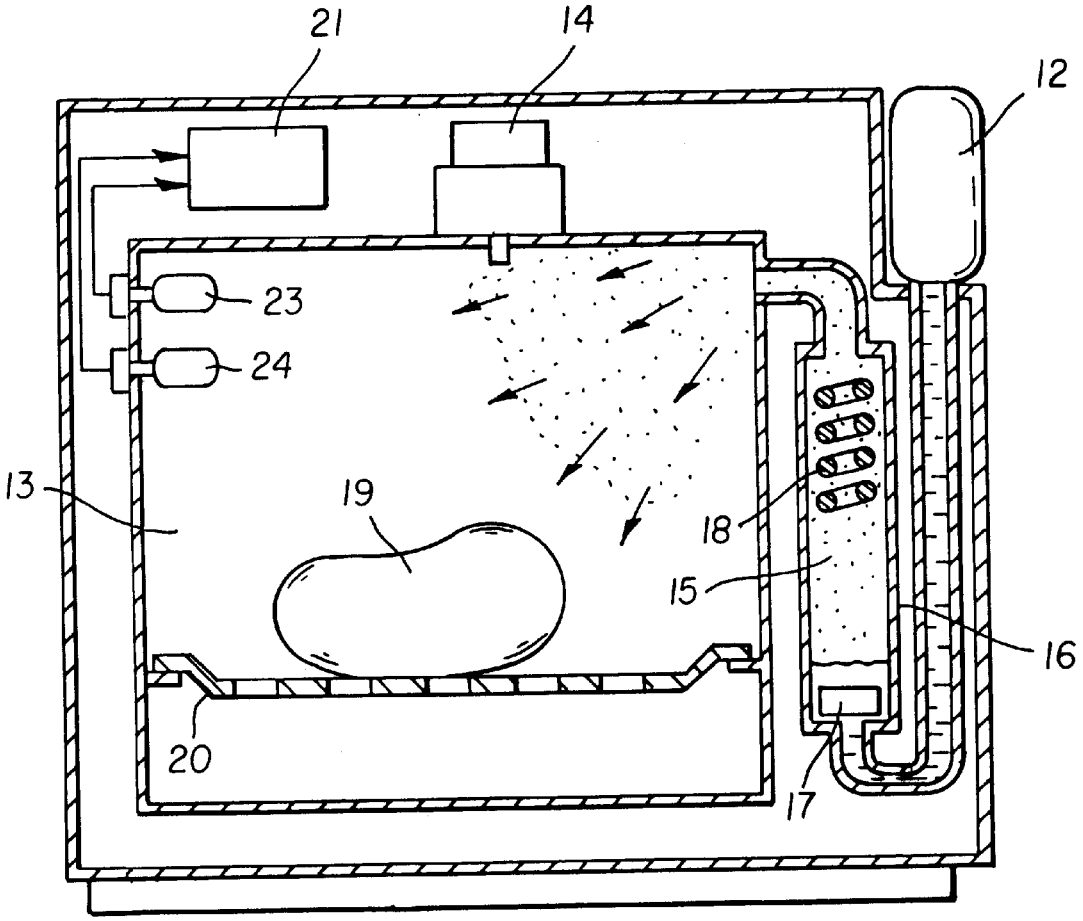
FIG. 5 shows cross sectional front view of a microwave heating cavity according to a second embodiment.
Figure 6A:
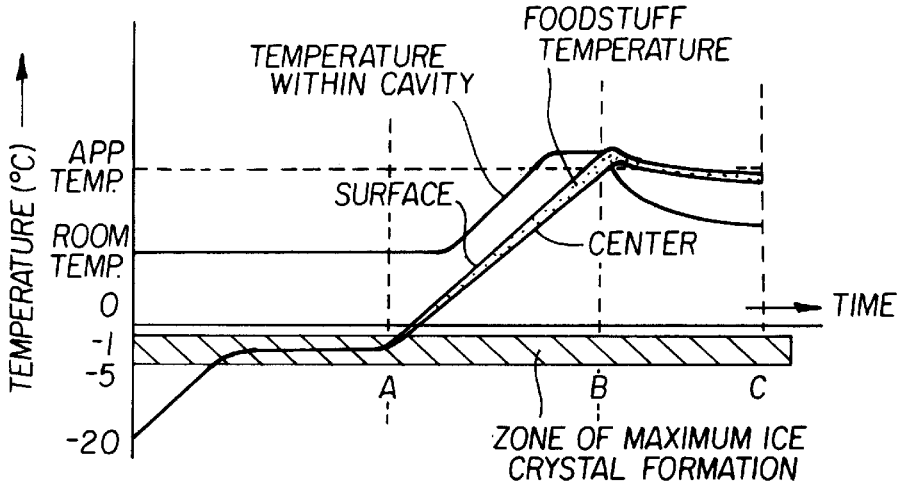
FIG. 6 shows a method of controlling the environment within heating cavity of a microwave heating apparatus according to a third embodiment.
Figure 6B:
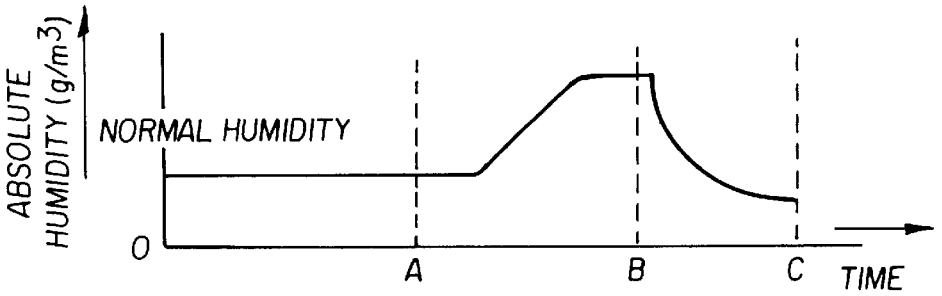
Figure 6C:
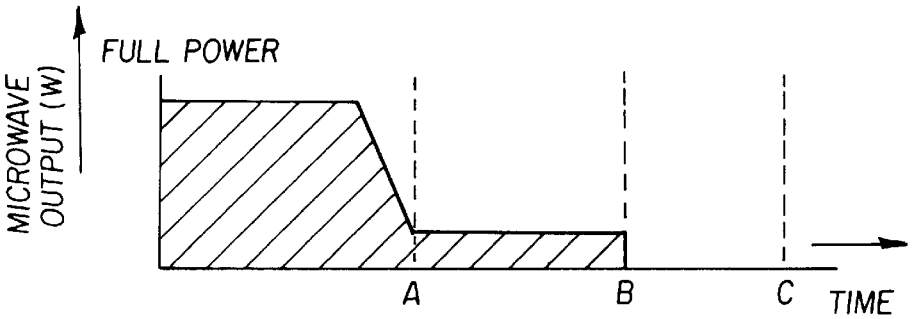
Figure 6D:
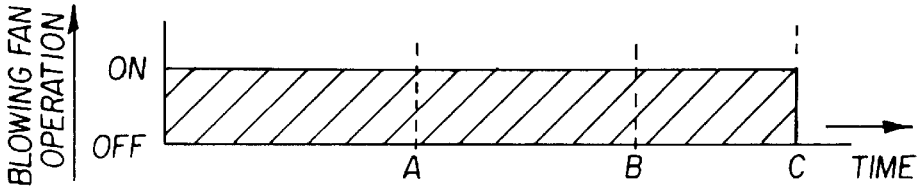
Figure 7A:
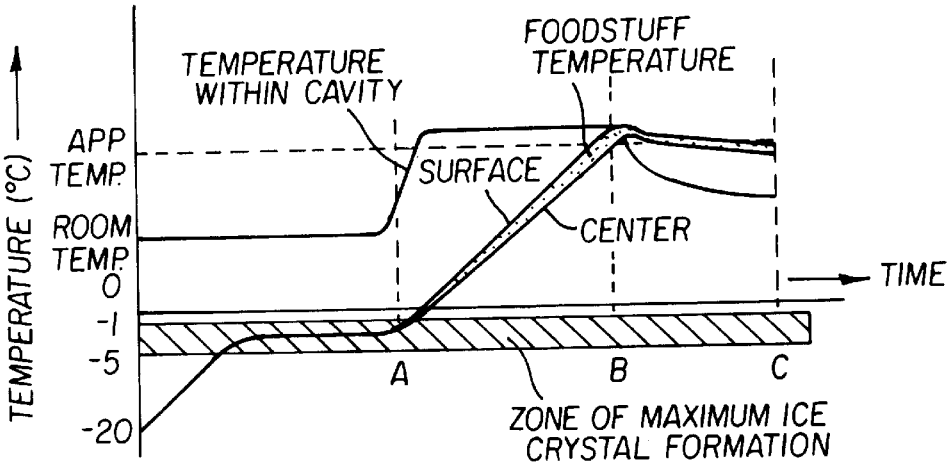
FIG. 7 shows a method of controlling the environment within heating cavity of a microwave heating apparatus according to a fourth embodiment.
Figure 7B:
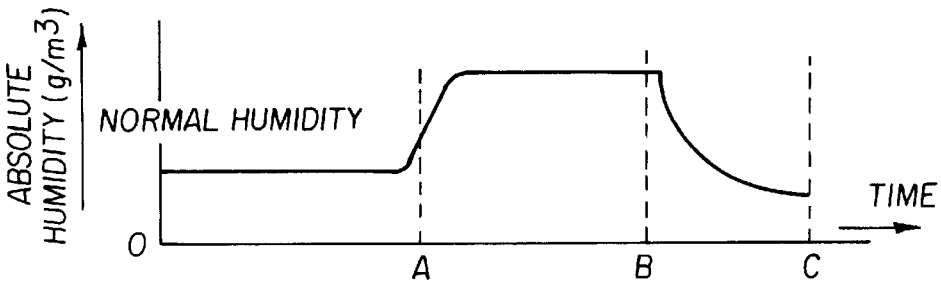
Figure 7C:
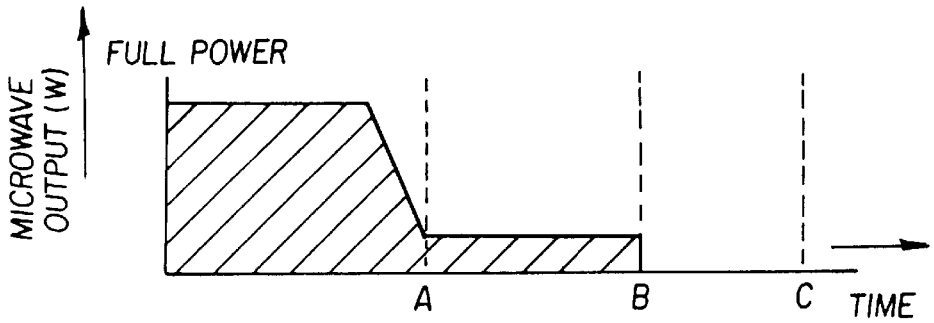
Figure 7D:
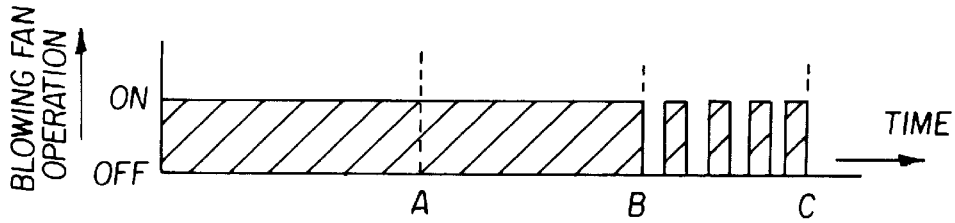

FIG. 5 is a cross sectional front view showing a heating cavity according to a second embodiment. In the first embodiment, heating work is carried out, upon receiving a heating instruction entered through an inputting means, in accordance with heating conditions recorded beforehand in a memory means. However, the environment of a foodstuff under a heating procedure may be better controlled with higher precision by providing a detecting means for measuring the environment within heating cavity and giving feedback to the power supply to steam generator. In heating cavity 13, a temperature sensor 23 and a humidity sensor 24 are disposed as an environmental detection means. Temperature and humidity within heating cavity 13 are detected, and supplied to a control section 21. This enables the control section to watch the environment within heating cavity precisely, and to see whether it is under a good control or deviating. In a case when the environment within heating cavity is deviating from a specification, power supply to steam generator 15 is varied to restore the environment to specification.

In the present embodiment, both temperature and humidity are detected to make the control sure. However, since a rough idea about the quantity of steam generation may be conceivable through the power supply to steam generator, the environment within heating cavity may be practically watched through detection of temperature alone.

(embodiment 3)

Figure 8:
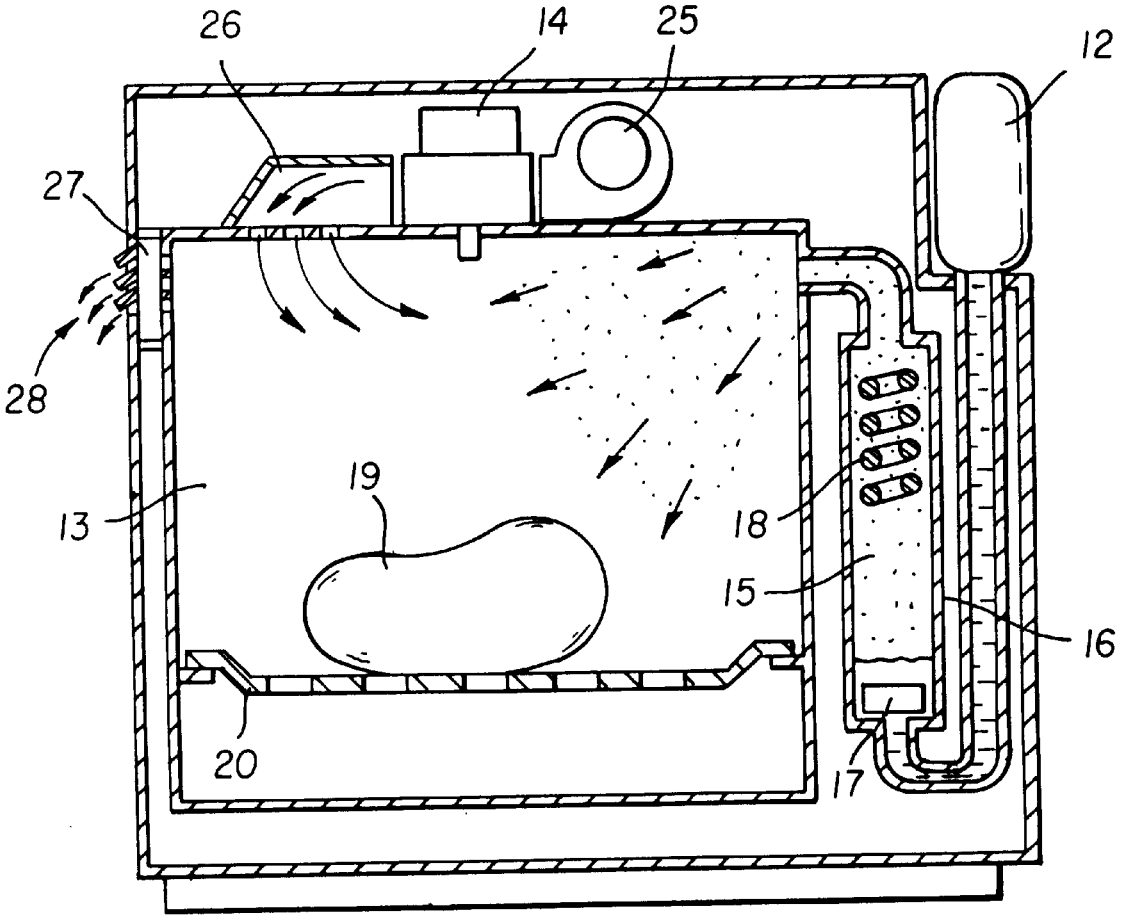
FIG. 8 shows cross sectional front view of a microwave heating cavity according to either a third or a fourth embodiment.

Now in the following an embodiment provided with an air blowing means is described. FIG. 8 shows a constitution containing an air blowing means; where, a fan 25, or an air blowing means, cools magnetron 14 and other components and then brings a certain quantity of air flow into heating cavity 13 guided by an air guide 26. This ventilation air agitates the uneven steam within heating cavity, and discharges redundant steam out of casing through an exhaust guide 27 and an exhaust hole 28 disposed in a part of the casing.

As described above, fan 25 mixes the air produced in steam generator 15 at a desired temperature and humidity with an outside air, enabling adjustment of the environment within heating cavity in a quicker and broader scale. Further, the flow of air within heating cavity makes it easier to control dryness in the surface of foodstuff. Foodstuff 19, a heating object, is placed on a tray 20 having substantial numbers of small holes or slits.

Figure 9:
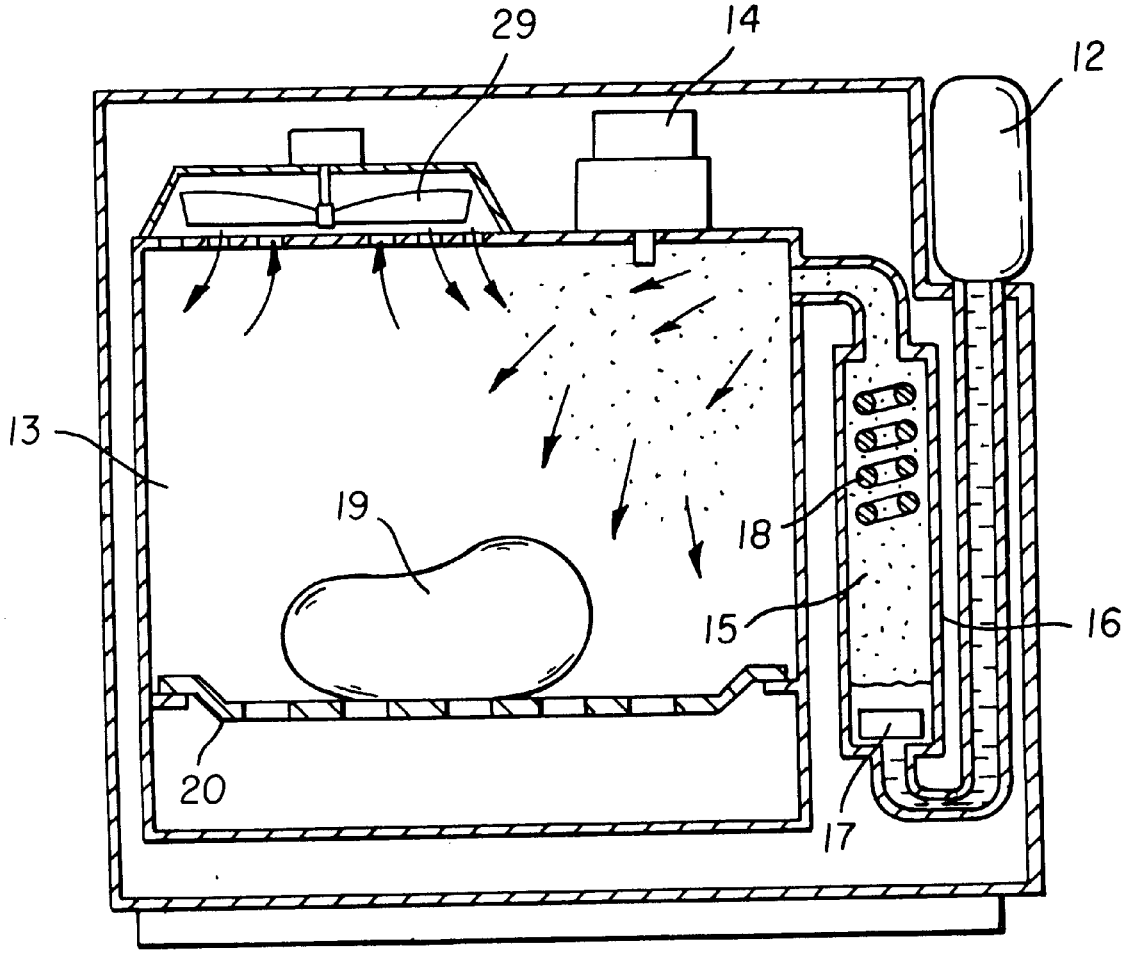
FIG. 9 shows cross sectional front view of another microwave heating cavity according to either a third or a fourth embodiment.

FIG. 9 is cross sectional front view of a heating cavity according to other form of the embodiment. In heating cavity 13, a circulation fan 29 is disposed instead of a fan provided as the air blowing means in the earlier described embodiment. Although it is impossible for circulation fan 29 to shift the temperature and humidity of the air discharged from steam generator 15 with a controlled temperature/humidity in a quicker and broader scale as the fan in the earlier described form of embodiment did, the circulation fan works effectively to improve the unevenness of temperature and humidity by agitating the air within heating cavity, while maintaining the once adjusted temperature and humidity within heating cavity 13. Further, the dryness in the surface of foodstuff can be controlled with ease through the control of speed and volume of air flow.

Figure 10:
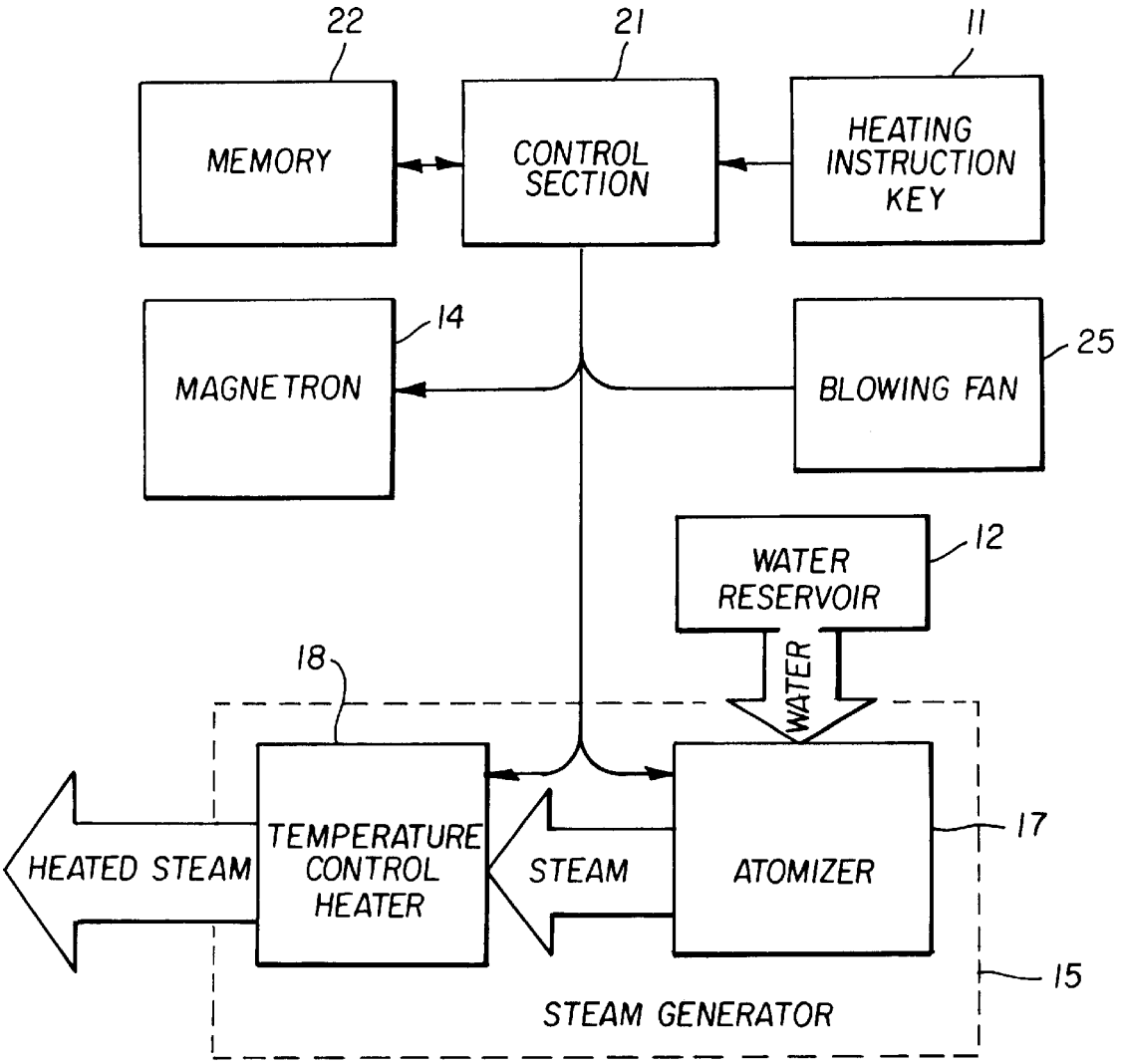
FIG. 10 is block diagram showing a constitution for controlling the environment within heating cavity of a microwave heating apparatus according to either a third or a fourth embodiment.

FIG. 10 is block diagram showing a control system; where, a control section 21 receives a heating instruction code entered at heating instruction key 11, and reads out corresponding heating conditions from memory 22 which is a storage means. As the heating conditions, control data of steam generator 15, viz. data of controlling the operation of atomizer 17 and controlling the input to temperature control heater 18, data showing power supply conditions to magnetron 14, and control data of fan 25, or a air blowing means, are stored in the memory. These data may be in a form of either time sequential control data for each respective block, or a mathematical formula. Control section 21 controls, in accordance with a time sequential data picked up from memory or a time sequential data obtained as the result of operation of the formula, the power supply to atomizer 17, temperature control heater 18, and magnetron 14, as well as the operation of fan 25, for controlling the temperature and humidity of steam to be introduced in heating cavity at each step of heating procedure, and the air flow and foodstuff temperature to predetermined conditions.

FIG. 6 shows a method of controlling the environment with the above described constitution. Where, (a) shows the temperature within heating cavity and the temperature of foodstuff under heating procedure, (b) transition of humidity within heating cavity, (c) microwave output, and (d) the operation of air blow fan.

In (a), the temperature of a foodstuff started from the freezing temperature(−20° C.) passes through the zone of maximum ice crystal formation(−1−−5° C.) taking some lapse of time (point A). Since a foodstuff absorbs microwave only slightly and has a good internal heat conduction, the microwave is generated at full power to be irradiated to the foodstuff during the first half of heating procedure, and then in the second half when part of the foodstuff starts melting the output is decreased to an appropriate level, as shown in (c). During the above thawing period, the temperature within heating cavity is maintained at room temperature or slightly higher than that, and the humidity at a normal humidity or lightly higher, as shown in (b). Namely, thawing is conducted mainly with microwave which goes deep into a foodstuff in frozen state, while the use of steam is suppressed.

After passing through the point A, the foodstuff in which melted part and frozen part coexist starts absorbing microwave significantly. As described earlier, the melted part (water) shows a dielectric loss several to several tens of times as high as that of frozen part, therefore the microwave output is reduced to a level about one fifth or sixth of the full power, as shown in (c). The temperature and humidity within heating cavity are raised after the point A or its vicinity, as shown in (a) and (b). When, the temperature within heating cavity is controlled, along with the progress of heating procedure, to keep almost an identical temperature as that of the food stuff. The control section searches the memory, upon receiving a code entered from heating instruction key, and reads out control data corresponding to the category and quantity of foodstuff, store temperature (frozen or chilled, etc.), heat-end temperature, and other items; and executes the control from time to time on steam generator, magnetron, and air blowing fan in accordance with these control data.

By the execution of such controls, the difference between the foodstuff itself and the surrounding environment is reduced to minimum, under which situation the exchange of temperature and moisture(water) is difficult to occur. Namely, when an average temperature in the core of foodstuff reaches an appropriate level(point B), the environmental temperature too is almost on an equal level, therefore thermal exchange and transfer of moisture at the surface of foodstuff is difficult to take place. Consequently, a bread an ideal temperature of which is the room temperature or a temperature slightly higher than bodily temperature does not get any material harm on the stuff because of very small in/out temperature difference; and a frozen bread may be thawed maintaining the same flavor and elasticity as it had when it was just baked and preserved until just before it was frozen, to an excellent condition, and the feeling to teeth is made to be comparable to the state as it was just baked. In a case of tempura, because at the time when temperature of inner stuff reaches at 60–70° C. the coating is also heated approximately to the same temperature, the inner stuff is not deprived of moisture by the coating, and keeps juicy state.

The surface of both bread and tempura at point B is somewhat moisturous affected by the steam. By keeping the air blowing fan running even after point B, as shown in (d), redundant moisture sticking on the surface of foodstuff can be swiftly removed. Therefore, it is effective for foodstuffs like the coating of tempura and the crust of bread which need to have a crunchy feeling to make the fan running for several minutes after the point B.

It has become clear after conducting experiments repeatedly that the coating which was heated with microwave alone becomes increasingly moisturous with the lapse of time, while the one heated under a controlled temperature/humidity provides a dry and crunchy feeling if the blowing fan was kept running additionally for several minutes after the point B. Such effect by the blowing air is called "effect from smooth/mild by on and off". It seems that when heated with microwave alone the temperature of inner stuff goes higher than the coating, and after the point B the moisture of inner stuff moves to the coating; so the deliciousness is affected by the coating getting moisturous and the inner stuff getting dehydrated.

According to the present invention, a small amount of moisture that is to be lost during the "effect from smooth/mild by on and off" after the point B may be provided in advance to the surface of a foodstuff; thereby creating a state through which a better state of foodstuff more similar to that of just-cooked is reproduced in several minutes afterwards.

The notice of completion is issued at point C by buzzer or other means. The delay time for issuing notice may be counted from the point B with a timer provided in the control section, or determined by detecting the temperature within heating cavity decreased to a certain level with a temperature sensor disposed in the heating cavity. By delaying the notice of completion to the point C, a cooking person may take a foodstuff out of oven totally relying upon notice, without thinking about an ideal timing of finishing. The delayed notice contributes also to the safety, because the temperature and humidity within heating cavity drop, if slightly, at the time when taking a foodstuff out of oven.

(embodiment 4)

Now in the following, other embodiment of control method under a constitution comprising an air blowing means is described. FIG. 7 illustrates an example of controlling the environment within heating cavity so that its temperature never goes beyond the temperature a foodstuff has at the completion of heating procedure.

In FIG. 7 which illustrates the present invention, (a) shows temperature within heating cavity and temperature of foodstuff during heating procedure, (b) transition of humidity within the heating cavity, (c) microwave output, and (d) operation of air blowing fan. In (a), the method of control from the start of heating upto the point A is totally the same as that of embodiment 1. The constitution of reducing microwave output after the point A to a level about one fifth or sixth of the full power as shown in (c) is also the same as that of embodiment 1. Air blowing fan keeps on running intermittently after the point B, as shown in (d), and foodstuff recieves intermittent air blow like wind by a handheld fan; which may bring the above described "effect from smooth/mild by on and off" more significant. Namely, when a foodstuff is exposed to a continuous wind blow its surface easily create uneven temperature spread; but when blown by an intermittent wind the temperature spread becomes more even helped by thermal conduction within foodstuff, enabling a good cooking with less uneven temperature spread.

Temperature as well as humidity within heating cavity are sharply raised after the point A, as shown in (a) and (b). The temperature within heating cavity is made to approximately coincide with the temperature a foodstuff should have at the completion of heating procedure; practically, the cavity temperature is set slightly higher. By the above described control mode, the foodstuff receives after the point A more significant influence in the temperature and humidity from the surrounding environment than in the earlier described control mode of embodiment 1, therefore heating proceeds more efficiently. The environment, however, never go beyond an appropriate temperature level of a foodstuff. Therefore, the low temperature zone or middle temperature zone heating for bread, tempura, etc. as well as the heating of delicate items which should be strictly protected from moisturing can be conducted in a subtle way, as in the method of embodiment 1.

In the present embodiment, any detecting means such as sensor is not employed, and the heating work is proceeded according to predetermined heating conditions stored in memory and designated by an heating instruction entered from input means. However, a detection means for detecting environmental conditions within heating cavity and entering the results as the feedback to power supply to steam generator may of course be provided. A temperature sensor and a humidity sensor may serve as the detection means.

Further, during the time after the end of heating(point C) until oven door is opened for taking foodstuff out the heating cavity may be used as a keep-warm chamber which keeps cooked meals warm without affecting the quality, by continuing only an environmental adjustment.

Based on a code entered from heating instruction key, control section picks up from memory the control data of steam generator and magnetron corresponding to the category and quantity of foodstuff, starting temperature(frozen or chilled, etc.), end of the heat temperature, and other items entered, and executes the control from time to time in accordance with these data.

(embodiment 5)

Figure 11A:
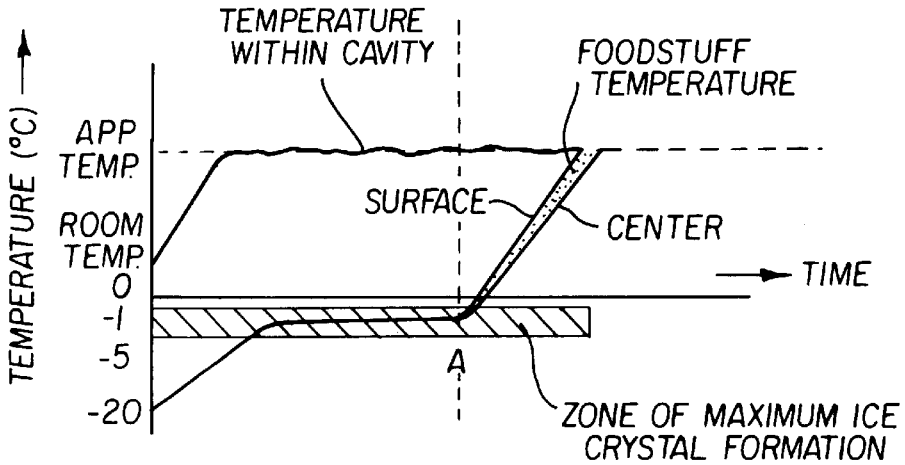
FIG. 11 shows a method of controlling the environment within heating cavity of a microwave heating apparatus according to a fifth embodiment.
Figure 11B:
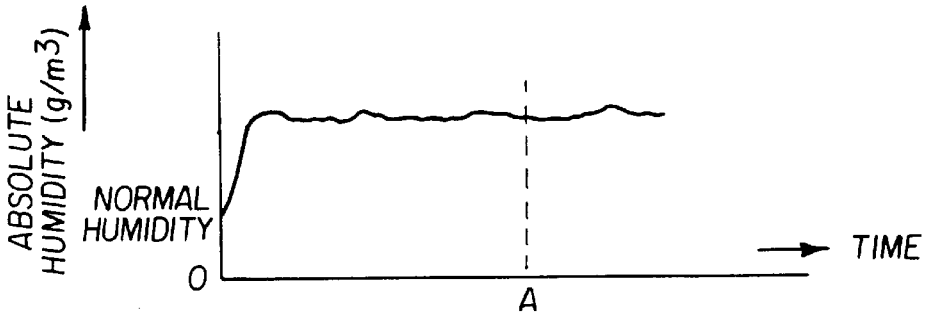
Figure 11C:
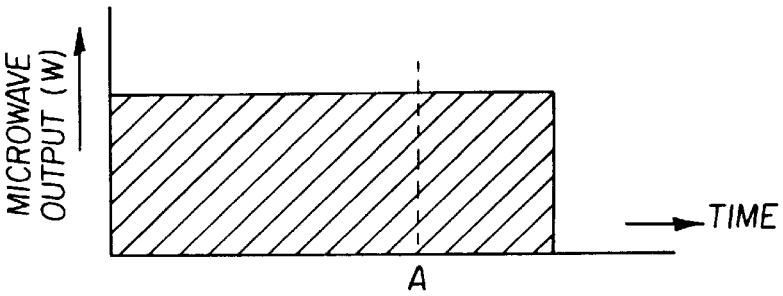

A fifth embodiment is described hereunder. FIG. 11 illustrates a heating method according to the present inventon, wherein the core and the surface temperatures of a foodstuff are raised with a relative evenness. Where, (a) shows temperature within heating cavity and temperature of food stuff during heating procedure, (b) transition of humidity within the heating cavity, and (c) microwave output. The temperature and humidity within heating cavity just before the end of heating are controlled to be a temperature and a humidity, respectively, which are suitable for a foodstuff to be appropriately cooked.

Referring to (a), the temperature of foodstuff starting from freezing temperature(−20° C.) climbs slowly until the zone of maximum ice crystal formation(−5−−1° C.), as the absorption of microwave is very small. In the zone of maximum ice crystal formation, the energy is consumed for melting the ice, therefore it takes some time before passing through the zone (point A). After passing the point A, the foodstuff starts absorbing microwave significantly resulting in a sharp increase of foodstuff temperature.

Since it takes some time before the temperature and humidity within heating cavity reaching a level of heat-end state as shown in (a), (b), the output of microwave (c) is controlled depending on foodstuff so as the heating/cooking procedure does not finish before the adjusting of environment is ready. In a case of a foodstuff whose temperature rise in the core is almost identical to that at the surface, it is not necessary to reduce the microwave output after the point A. In this way, the environment within heating cavity is well adjusted to be corresponding to the heat-end state; therefore a foodstuff is mildly heated from the surface with latent heat of steam, at the same time with microwave. Consequently, the foodstuff is heated swiftly with well balanced temperatures in the core and the surface when the heating/cooking procedure is completed. Further, as the moisture on the surface of foodstuff is preserved well, boiled rice or pasta does not get dried, nor wetted.

(embodiment 6)

Figure 12A:
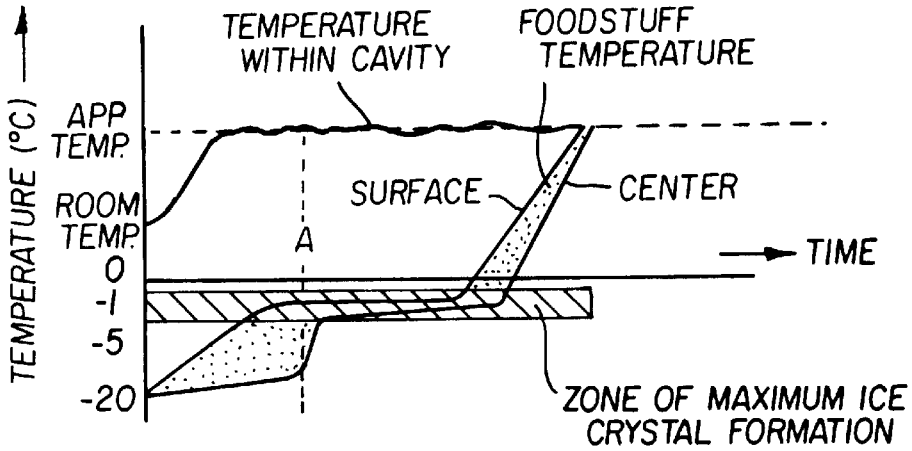
FIG. 12 shows a method of controlling the environment within heating cavity of a microwave heating apparatus according to a sixth embodiment.
Figure 12B:
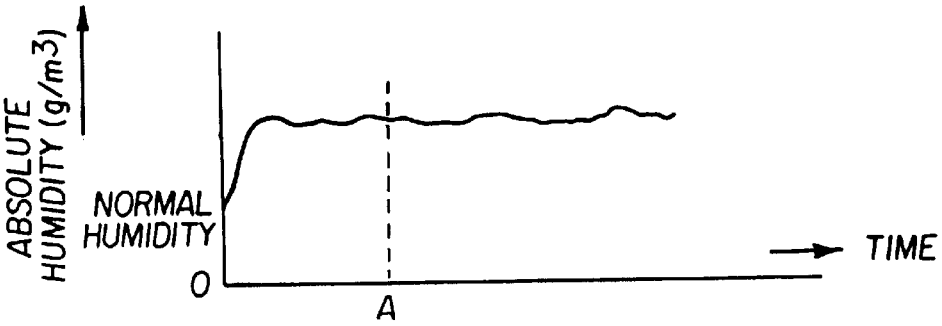
Figure 12C:
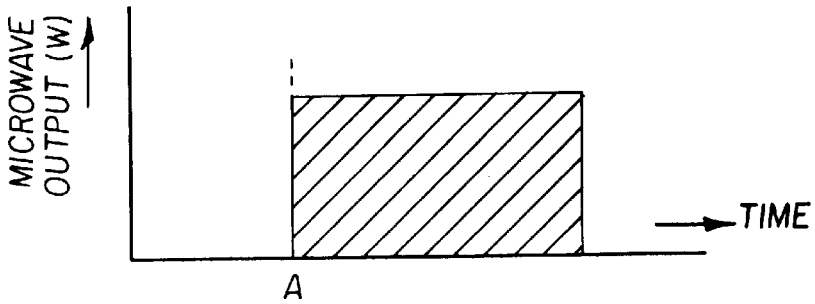

In the following a sixth embodiment is described. FIG. 12 shows a heating method according to the present invention for heating a foodstuff whose core part is heated earlier than the surface; where, (a) shows temperature within heating cavity and temperature of foodstuff during heating procedure, (b) transition of humidity within heating cavity, and (c) microwave output. The temperature and humidity within heating cavity just before the end of heating are controlled to be a temperature and a humidity, respectively, which are suitable for a foodstuff to be appropriately cooked.

Starting from freezing temperature(−20° C.), if a foodstuff is irradiated by microwave from the beginning the microwave goes into the core part and the core part is heated first. Therefore, as shown in (a) and (b), temperature and humidity within heating cavity are adjusted to be immediately reaching a level of the end of heating procedure; and steam is made to be condensing on the surface of foodstuff taking advantage of the temperature difference between environment and foodstuff, and a layer of water is formed by the temperature of environment. At the time when the surface of foodstuff starts melting (point A), heating with microwave is initiated as shown in (c). Then a part of microwave which should have gone into the core part is absorbed by the surface of foodstuff, heating the foodstuff from both inside and outside in a well balanced way. As a practical example, a shao-mai is warmed homogeniously, avoiding such an inconvenience that a tepid temperature shao-mai is very hot inside when chewed. Furthermore, the surface of shao-mai is not dried, and is well preserved with moisture and softness to the conservation of its original deliciousness. It is also confirmed by experiments that the weight reduction after heating is less among those heated according to a method of the present invention, as compared with those heated by microwave alone. In a case of shrimp tempura, since shrimp and the coating are heated at almost same temperature, such inconvenience as the shrimp going stiff as a result of dehydration caused by move of the moisture containted in the shrimp, temperature of which reached high earlier than the coating, to the coating, consequently the coating loses the crispy touch, is preventable. According to the result of experiments, the coating of those tempuras heated by a heating method according to the present invention is more moisturous as compared with those heated by microwave alone at a time immediately after the end of heating procedure, but when they are served on a table the coating resumed its crispy feeling, as the redundant water gradually evaporated away in the course of time.

(embodiment 7)

Figure 13A:
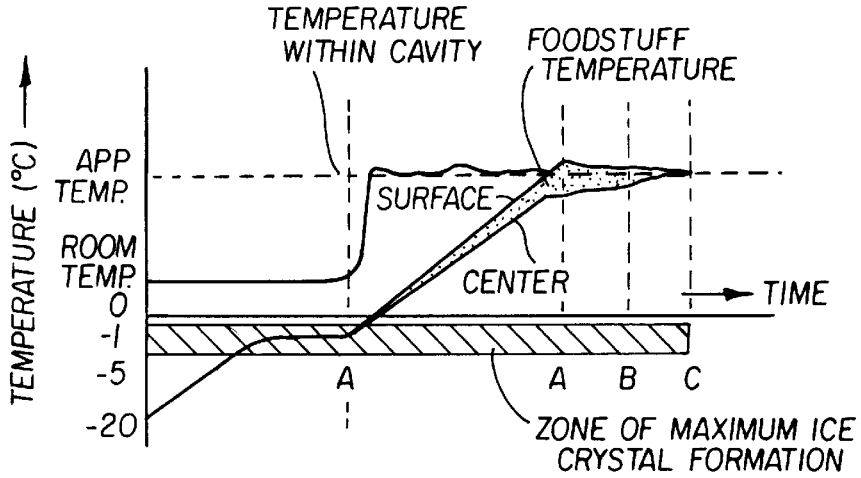
FIG. 13 shows a method of controlling the environment within heating cavity of a microwave heating apparatus according to a seventh embodiment.
Figure 13B:
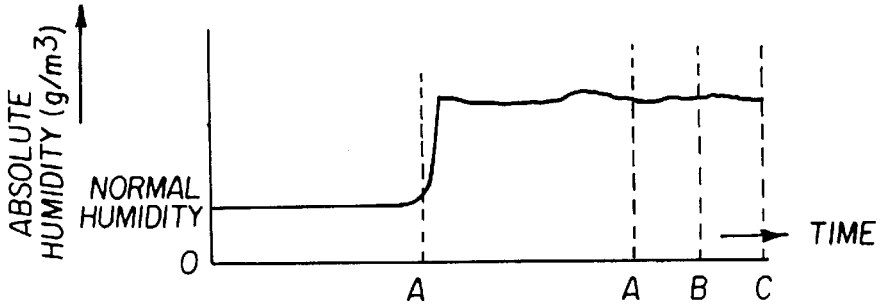
Figure 13C:
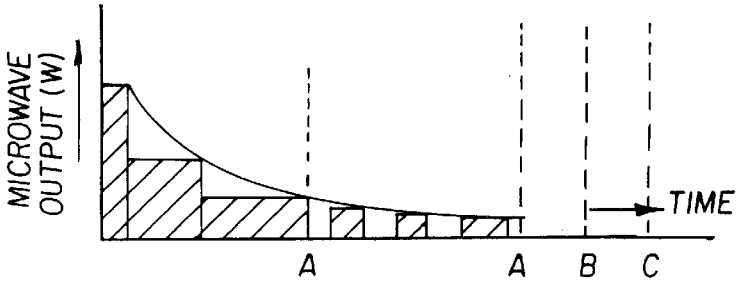

A seventh embodiment is described hereunder. FIG. 13 shows a heating method according to the present invention for heating a foodstuff whose surface is heated earlier than the core part; where, (a) shows temperature within heating cavity and temperature of foodstuff during heating procedure, (b) transition of humidity within heating cavity, and (c) microwave output. Starting from freezing temperature(−20° C.), the temperature of foodstuff passes through the zone of maximum ice crystal formation (−1−−5° C.) taking some lapse of time (point A).

Since microwave is absorbed by foodstuff only slightly upto the point A from the start, and goes deep inside the foodstuff, microwave is irradiated to frozen food with the full output during the first half of heating procedure, as shown in (c). In order to have the microwave reaching well inside the foodstuff, it is important to prevent the surface of foodstuff from melting itself or absorbing moisture. Therefore, until the foodstuff partially starts melting (point A), temperature control within heating cavity is suspended as shown in (b). Namely, thawing of foodstuff is conducted mainly with microwave which is capable of permeating deep into a foodstuff in frozen state, meanwhile steaming is suspended.

After passing through the point A, the foodstuff, in which melted part and frozen part coexists, starts absorbing microwave significantly. As described earlier, the melted part (water) shows the dielectric loss several to several tens of times as high as the frozen part; which makes temperature difference between the melted and the frozen larger. Therefore, as shown in (c), microwave output is gradually lowered to about one fifth or sixth of the full power, and heating is kept on going allowing conduction of heat from high part to low part. After passing the point A, the temperature and the humidity within heating cavity are adjusted respectively to coincide with the state at the end of the heating procedure of foodstuff, as shown in (a) and (b); thus steam surrounds the surface of foodstuff and helps the inside temperature go up. In a case where the inside temperature is still too low when the surface reached to the heat-end temperature(point B), microwave radiation is terminated at the point B, as shown in (c), and wait for the inside temperature go up while continuing the control of temperature and humidity, as indicated in (a), (b). When applied to e.g. hamburger or curry and rice, the present heating method warms these items entirely to the inside to a good temperature, avoiding the surface going too hot and dried or boiled down.

(embodiment 8)

Now in the following, an eighth embodiment comprising an independent heating means in order to completely prevent dew condensation in heating cavity is described.

Figure 14:
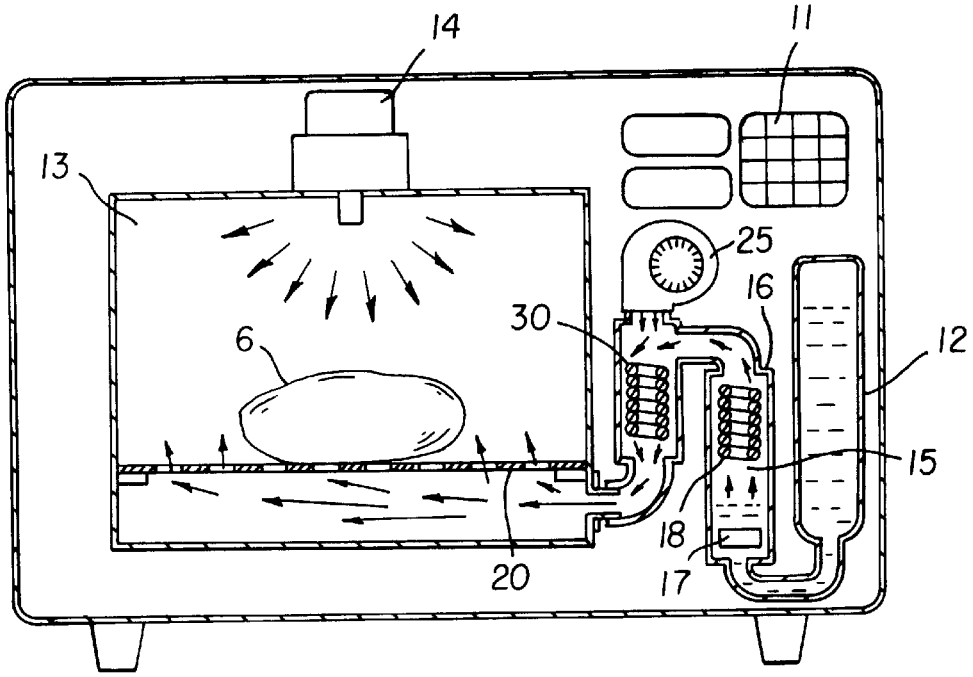
FIG. 14 shows cross sectional front view of a microwave heating cavity according to an eighth embodiment.

As the independent heating means, a heating device 30 is provided, besides a steam generator 15, in the steam discharge path, as shown in FIG. 14. Prior to generation of steam, a control section starts power supply to the heating means to raise the temperature of heating cavity. With such constitution, the condensation of dew on cold wall surface of heating cavity is prevented at far higher certainty.

By virtue of the independent heating means, the temperature and the humidity within heating cavity are adjusted not to cause dew condensation on inner wall surface of heating cavity, through the control on power supplies to steam generator 15 and heating device 30. The effectiveness is remarkable when the environment within heating cavity is adjusted to be lower than 90% in relative humidity.

(embodiment 9)

Figure 15:
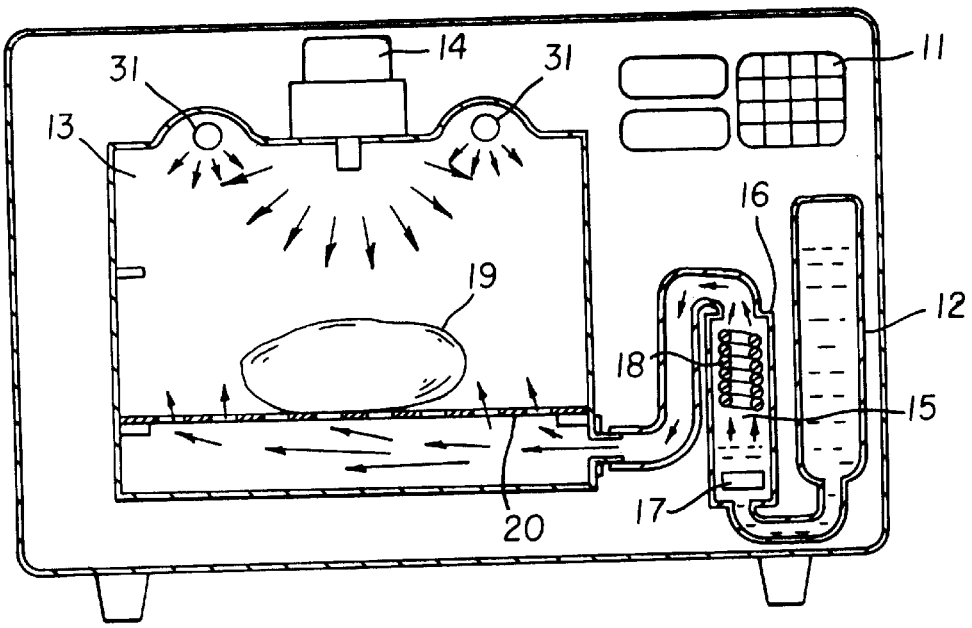
FIG. 15 shows cross sectional front view of a microwave heating cavity according to a nineth embodiment.

Now in the following, a nineth embodiment comprising an independent heating means in order to completely prevent dew condensation in heating cavity is described. FIG. 15 shows an example of a microwave heating apparatus comprising an electric heater in heating cavity. Among the environment adjusting means, heating device 30 may be replaced with such electric heater 31 for an integrated function.

It is not intended to limit the steam generator to a type as depicted in the present embodiment; it may be a seize heater or the like dipped into an ordinary boiler, or attached by blazing around the tank, for example. In such a setup, in order to allow a free control of steam temperature, a part of heater should preferably be extruding above the water level of the boiler so that the temperature of generated steam can be further raised.

(embodiment 10)

Figure 16:
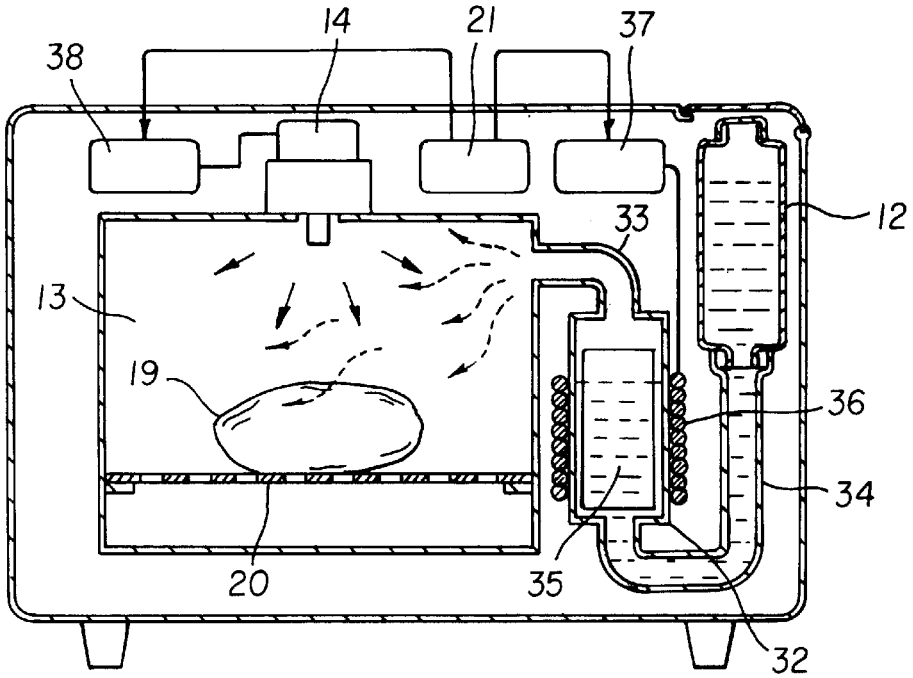
FIG. 16 shows cross sectional front view of a microwave heating cavity according to a tenth embodiment.

Now in the following, other embodiment of the present invention is described referring to drawings. FIG. 16 shows cross sectional view of a microwave heating apparatus according to other embodiment of the present invention. A magnetron 14, or a microwave generating means, is provided in a heating cavity 13 for irradiating microwave inside of heating cavity 13. Provided at a side of heating cavity 13 is a steam generator 32 comprised of non-magnetic material. One end of steam generator 32 is coupled with heating cavity 13 via a discharge duct 33, the other end with a water reservoir 12 via an inflow tube 34. Within steam generator 32, a heating element 35 comprised of a magnetic metal is housed. Ideally, steam generator 32 shall be mostly filled with heating element 35. Heating element 35 may be comprised of any material of any shape, in so far as it generates heat with magnetic fields; in the present embodiment, a metal substance shaped in a form of continuous foam or fiber is used in order to maximize the contact surface with water.

In a case where steam generator 32 is comprised of a magnetic material, instead of non-magnetic material, heating element 35 turns out to be unnecessary; in this case, however, the volume of water staying in steam generator 32 increases and takes a longer time before it starts generating steam; therefore, some contrivance becomes necessary, such as inserting a hollow body or the like in the steam chamber in order to reduce the effective volume of water in the chamber, heating the water in advance, or some other means.

Around steam generator 32, an exciting coil 36 is provided, which is connected with an inverter power supply 37 for supplying an alternating current. With the power supplied from inverter power supply 37, exciting coil 36 produces an alternating magnetic fields. With the alternating magnetic fields, an eddy current is created in heating element 35, which makes heating element 35 generate heat. The water in steam generator 32 is heated by the heat generated from heating element 35 and vapours, which vapour proceeds to heating cavity 13 through discharge duct 33. Numeral 38 denotes a high tension power supply for supplying high voltage power to magnetron 14. A controller 21 conducts the ON/OFF operation of inverter power supply 37 and high tension power supply 38, or the power control of respective power sources. Within heating cavity 13, a tray 20 having openings that allow the steam go through is disposed to place a foodstuff 19 on.

Exciting coil 36 itself does not generate any heat; instead, the eddy current makes heating element 35 generate heat, to be conducted direct to the water. Thus, steam is produced efficiently.

The steam generator 32 is defined by a generally cylindrical shell made of an insulating material of a kind having a heat resistance and an insulating property such as, for example, heat-resistant glass or porcelain, having a wall thickness greater than the distance of insulation relative to the voltage applied to the exciting coil 36, that is, greater than a value sufficient to avoid any possible dielectric breakdown which would take place at the voltage applied to the exciting coil 36.

The heating element 35 may be made of a porous metallic material having a sufficient water-resistance and a corrosion resistance such as, for example, Ni, Ni—Cr alloy or stainless alloy.

Figure 17:
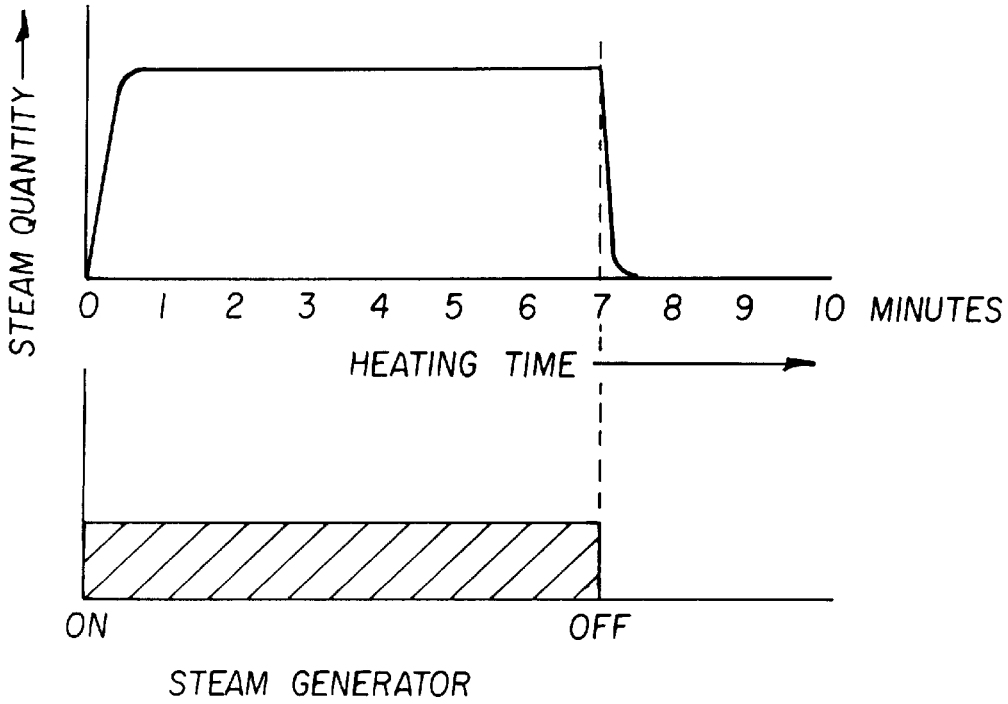
FIG. 17 shows a method of controlling the environment within heating cavity of a microwave heating apparatus according to a tenth embodiment.

FIG. 17 illustrates amount of vapour in the heating cavity. What FIG. 17 shows is the change of steam quantity within heating cavity as the heating time elapses; at the time when heating is started the steam generator also starts working, and stops working when the heating is ended. According to experiment, wherein heating element 35 is heated with 400 W output power from inverter power supply 37, steaming began in approximately 10 sec. and ended in approximately several seconds after the heating is stopped. Thus, the start and stop of steam generation took place with a much quicker response to the operation of steam generator, as compared with conventional constitutions. Further, the steam was produced by a substantially small power consumption. This is because the alternating magnetic fields of exciting coil 36 powered by inverter power supply 37 instantaneously heated heating element 35 to heat the water in steam generator 32, and steam was efficiently generated. The efficiency is remarkable when heating element 35 is comprised of a metal in a form of continuous foam or fiber, which has a large contact area with water. Also because of a fact that the proportion of volume of water within steam generator 32 is lessened by the existence of heating element 35, steam is easily generated by heating only a small quantity of water, which enables the quick start up of steaming.

Generally speaking, the shorter start up time is preferred; practically, it should be shorter than 1 min., preferably approximately 10 sec.

(embodiment 11)

Figure 18:
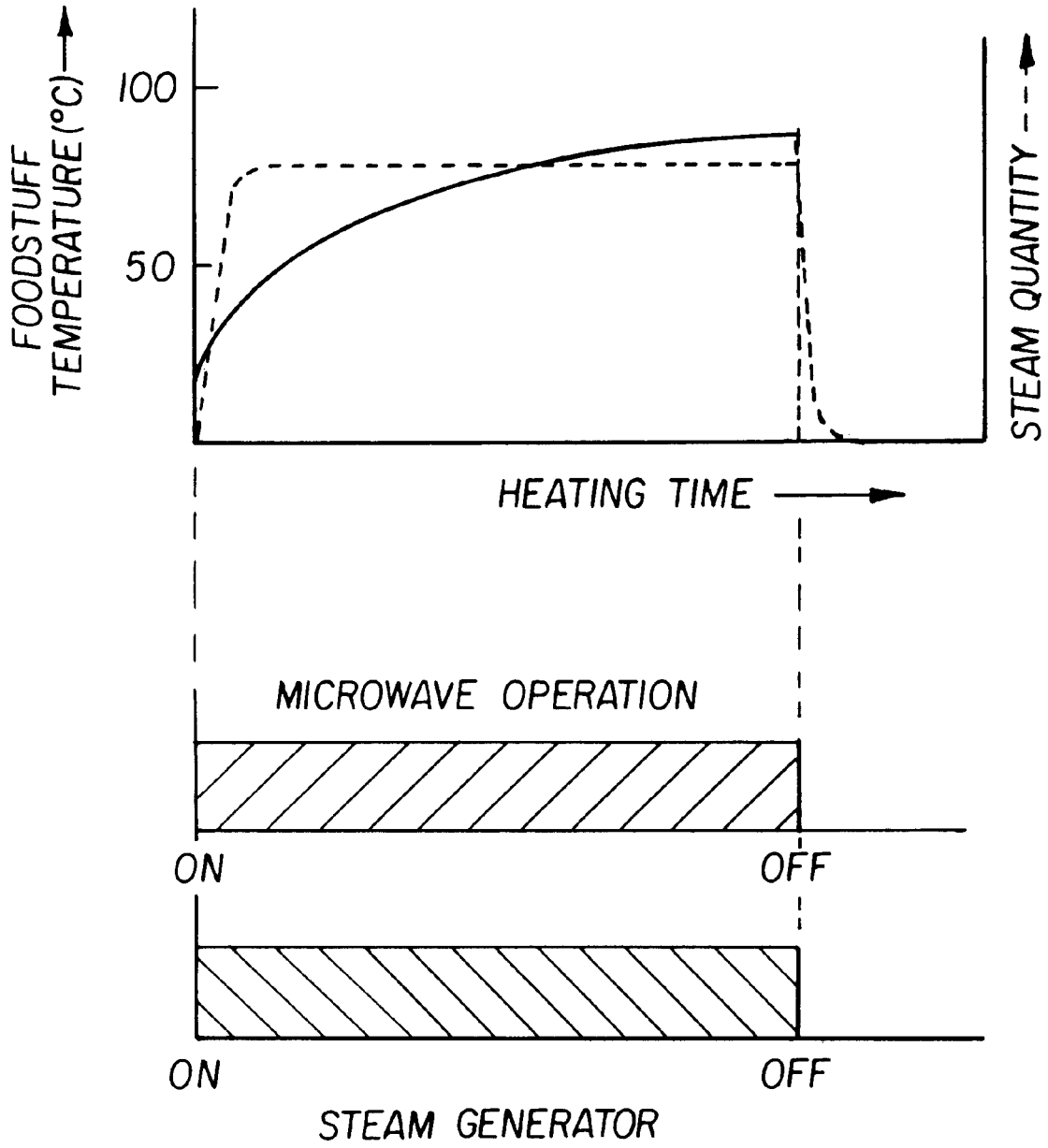
FIG. 18 shows a method of controlling the environment within heating cavity of a microwave heating apparatus according to an eleventh embodiment.

FIG. 18 shows relationship between temperature of foodstuff and quantity of steam within heating cavity of a microwave heating apparatus according to an eleventh embodiment. In FIG. 18, the operation of microwave generating means and steam generating means are started at a same time when heating procedure is started. Also, when heating is ended, the operation of the above two means are discontinued at the same time. Because of the quick start up of steam generator, although the operation of steam generator is started at a same time when microwave operation is started, foodstuff is cooked with both microwave and steam through most of the heating/cooking time, with an exception of the initial several seconds when heating is conducted solely with microwave; thus, heating is conducted while suppressing moisture evaporation from foodstuff. Therefore, a subtle heating/cooking is implemented to produce an excellent finish, without losing an appropriate humidity in a foodstuff.

(embodiment 12)

Figure 19:
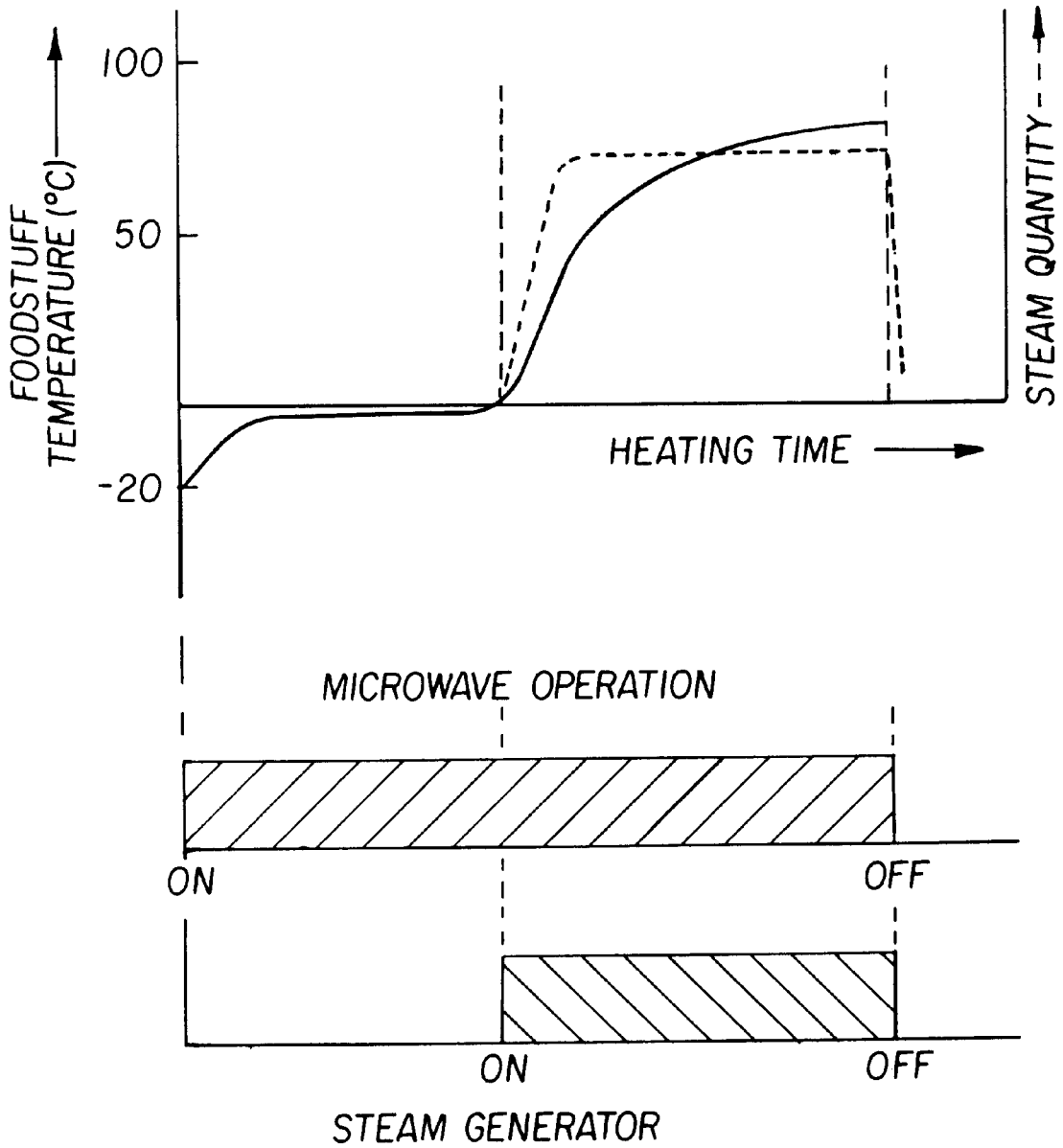
FIG. 19 shows a method of controlling the environment within heating cavity of a microwave heating apparatus according to a twelfth embodiment.

FIG. 19 shows relationship between temperature of foodstuff and quantity of steam within heating cavity of a microwave heating apparatus according to a twelfth embodiment. In FIG. 19, a foodstuff is heated solely with microwave while the food stuff is in frozen state, or below zero, as it is easier for microwave to go into frozen foodstuff. Thawing goes ahead, and as soon as temperature of foodstuff reaches almost above zero, a steam generator is started to heat/cook the foodstuff with both microwave and steam. Moisture easily evaporates from foodstuff when foodstuff temperature exceeds 0° C. In the present heating method, however, foodstuff is surrounded with steam; therefore, it is heated while preventive measure against moisture evaporation is being taken. Thus, foodstuff may be heated/cooked in a good environment resulting in an excellent finish conserving appropriate humidity, without dehydration. Further, as the steam generator is put into operation only during the time of needs, redundant use of power is avoided making a contribution to the energy saving.

(embodiment 13)

Figure 20:
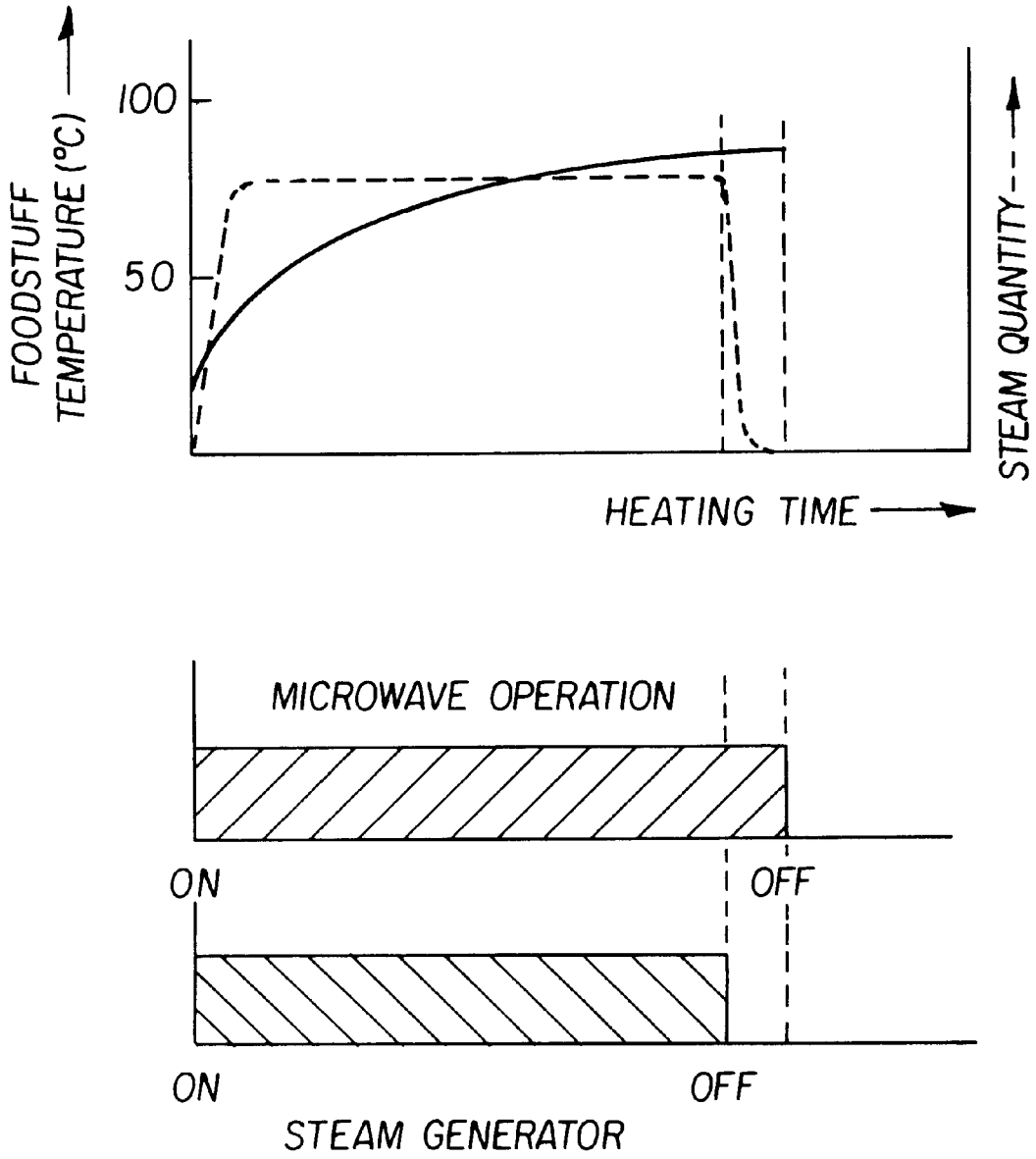
FIG. 20 shows a method of controlling the environment within heating cavity of a microwave heating apparatus according to a thirteenth embodiment.

FIG. 20 shows relationship between temperature of foodstuff and quantity of steam within heating cavity of a microwave heating apparatus according to a thirteenth embodiment. In FIG. 20, the operation of microwave generating means and steam generating means are started at a same time when heating procedure is started. At the ending, operation of steam generating means is terminated earlier by a certain time span during which the steam in heating cavity decreases, after that the microwave operation is turned off. By so doing, quantity of the steam in heating cavity decreases when heating procedure is ended, consequently it is easy and safe for a cooking person to take the foodstuff out, without being exposed to hot steam.

(embodiment 14)

Figure 21:
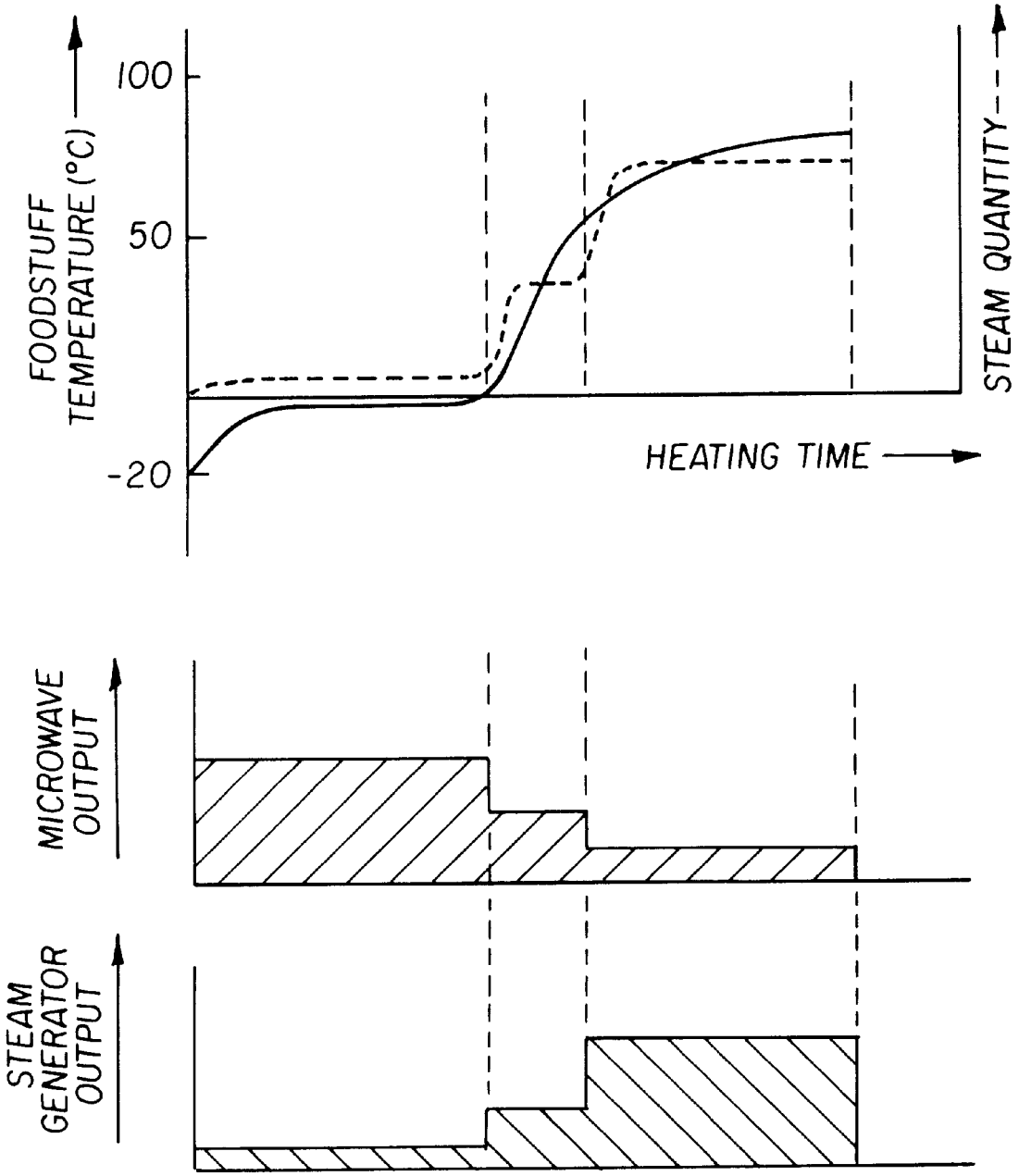
FIG. 21 shows a method of controlling the environment within heating cavity of a microwave heating apparatus according to a fourteenth embodiment.

FIG. 21 shows relationship between temperature of foodstuff and quantity of steam within heating cavity of a microwave heating apparatus according to a fourteenth embodiment. In FIG. 21, foodstuff is heated with microwave at high output power and steam generator at low power operation while the foodstuff is in frozen state, or below zero temperature. Next, as the thawing proceeds and temperature of foodstuff reaches almost above zero, the output of microwave is lowered to medium, while the output of steam generator is raised to medium. After the temperature of foodstuff reached a medium zone, the output of microwave is decreased to low, while the output of steam generator is increased to high. The outputs of microwave and steam are thus varied along with the progress of heating procedure. For example, while foodstuff is still in frozen state thawing is quickly done with microwave which has an advantage of permeating deep into the ice; and then foodstuff is gradually heated with medium output microwave and steam in order to preventing the foodstuff from being heated unevenly. The medium output steam is effective to keep the temperature homogeneous within a foodstuff, and to prevent the evaporation of moisture. At the final stage where the foodstuff temperature goes considerably high and the uneven temperature within foodstuff is easy to occur, heating is carried out slowly with lower output microwave making use of the thermal transfer, or a transferred heating, within the foodstuff. When temperature of foodstuff is high, moisture easily evaporates from the foodstuff. However, in the present embodiment, as the cavity is filled with a substantial amount of steam the evaporation is surely prevented, at the same time the steam works to give heat to the foodstuff. Consequently, heat dissipation from the surface of foodstuff is prevented, moreover the foodstuff is heated from the surrounding surfaces, therefore the foodstuff is homogeneously heated/cooked, conserving the moisture, without dehydration, bringing about a subtly prepared meals.

(embodiment 15)

Figure 22:
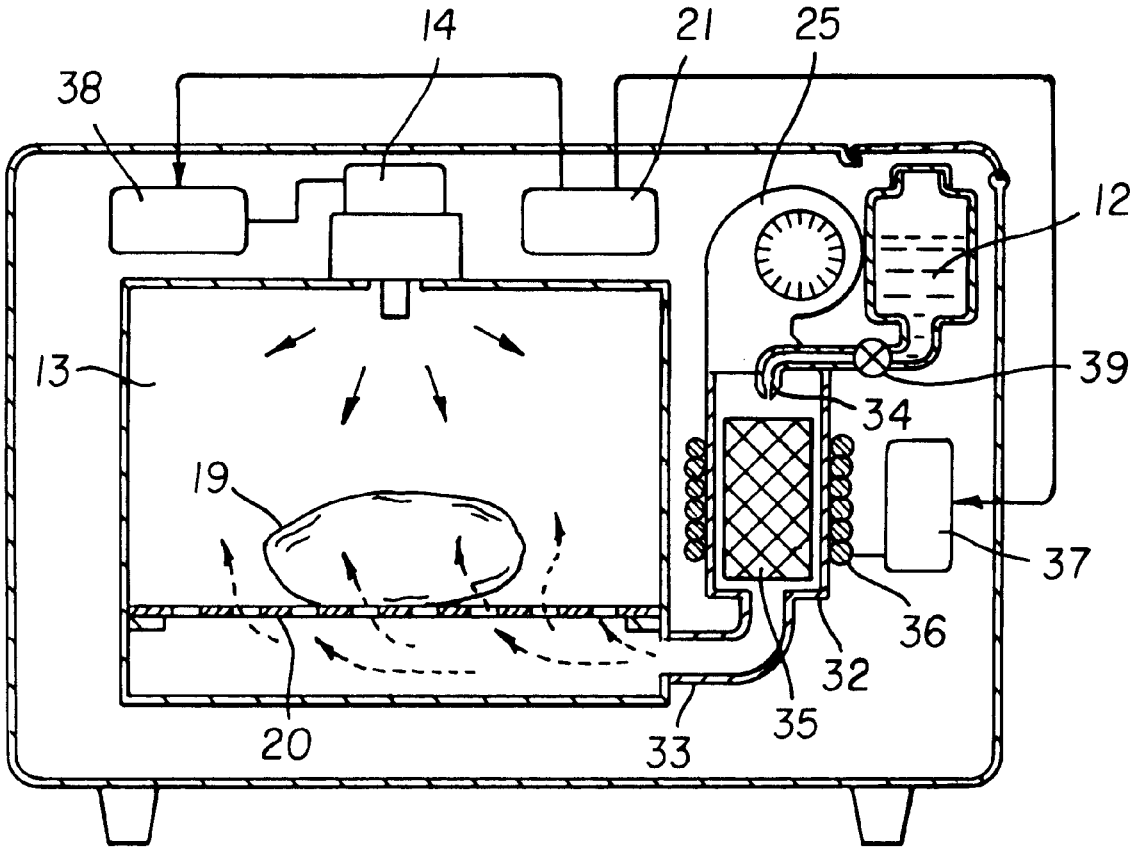
FIG. 22 shows cross sectional front view of a microwave heating apparatus according to a fifteenth embodiment.
Figure 23:
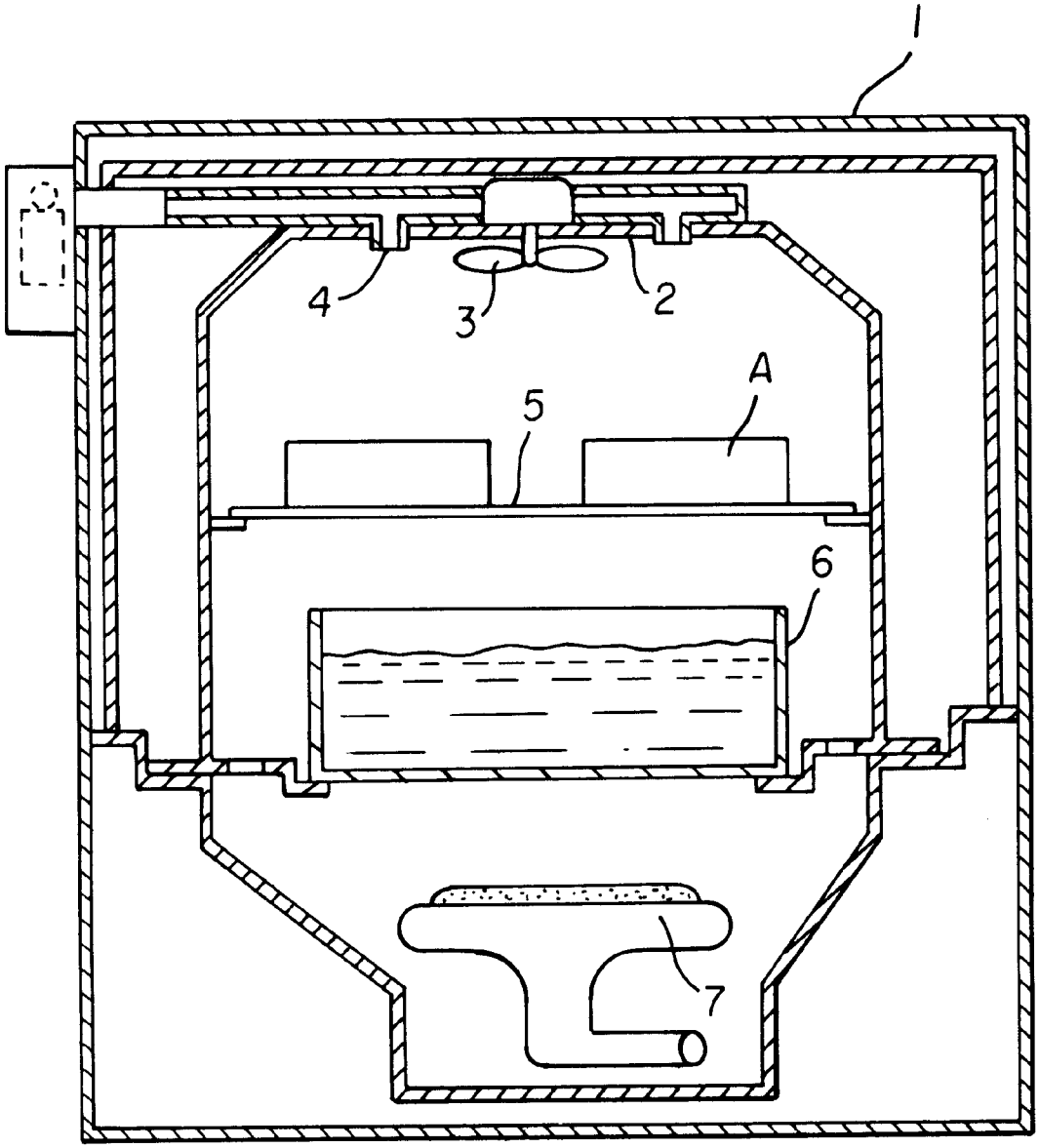
FIG. 23 (Prior Art)
FIG. 23 shows cross sectional front view of a prior art heating cavity of thawing/cooking oven.
Figure 24:
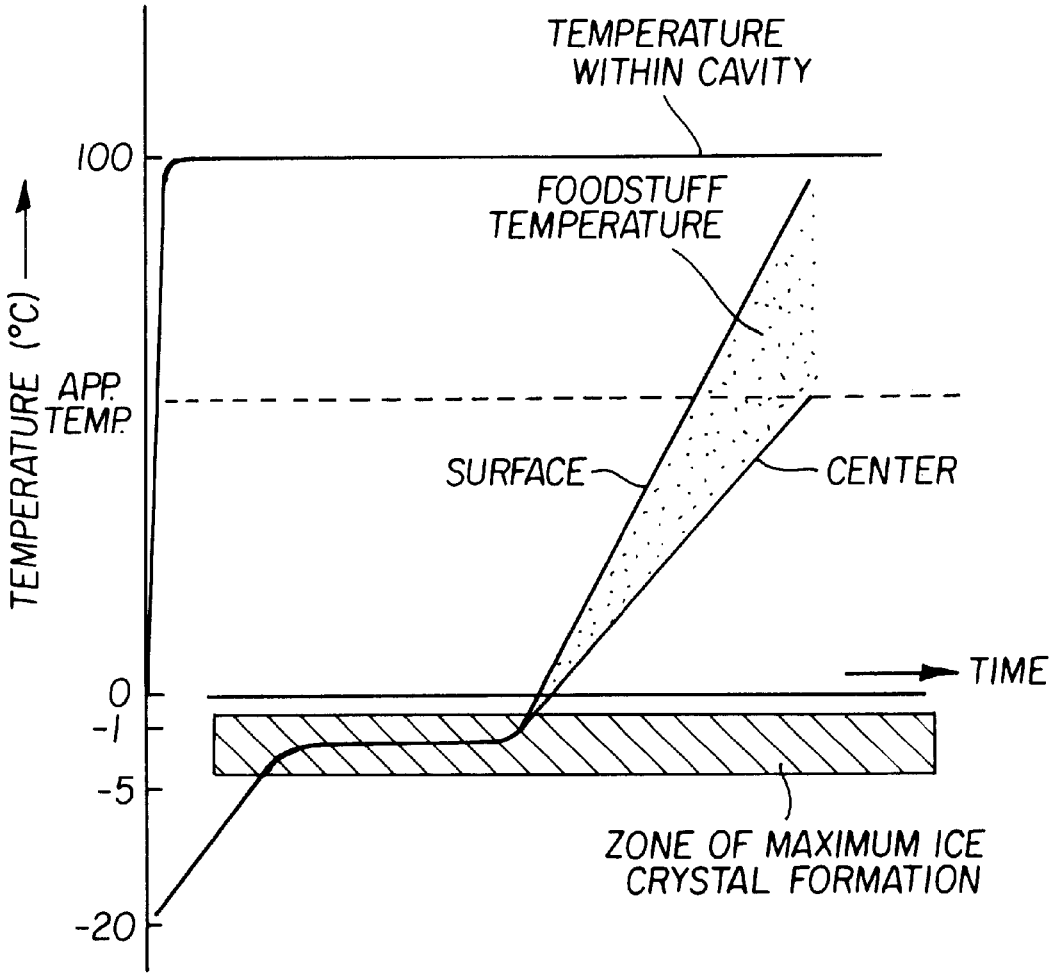
FIG. 24 (Prior Art)
FIG. 24 shows a method of controlling the environment within heating cavity of a prior art thawing/cooking oven.

FIG. 22 shows cross sectional view of a microwave heating apparatus according to a fifteenth embodiment. A magnetron 14, or a microwave generating means, is provided in a heating cavity 13 for radiating microwave inside of heating cavity 13. Provided at a side of heating cavity 13 is a steam generator 32 comprised of non-magnetic material. Bottom end of steam generator 32 is coupled with heating cavity 31 via a discharge duct 33, top end with a water reservoir 12 via an inflow tube 34. A valve 39 is disposed between inflow tube 34 and water reservoir 12 for regulating the flow of water. Within steam generator 32, a heating element 35 comprised of magnetic metal is housed. Heating element 35 is comprised of metal substance shaped in a form of continuous foam or fiber in order to maximize the contact surface with water. Around steam generator 32, an exciting coil 36 is provided which is connected with an inverter power supply 37 for supplying an alternating current. With the power from inverter power supply 37, exciting coil 36 produces alternating magnetic fields. With the alternating magnetic fields, eddy current is produced in heating element 35, which makes the heating element generate heat. From the top of heating element 35, water from water reservoir 12 is provided via inflow tube 34. The flow of water is controlled by valve 39 so that water drips only for a quantity needed for evaporation. The water dripping in steam generator 32 is heated by the heat generated from heating element 35 and vapours, which vapour proceeds to heating cavity 13 through discharge duct 33. A fan 40 blows the steam produced in steam generator 32 into heating cavity 13. Numeral 38 denotes a high tension power supply for supplying high voltage power to magnetron 14. A controller 21 conducts the ON/OFF operation of inverter power supply 37 and high tension power supply 38, or the power control of respective power sources. Within heating cavity 13, a tray 20 having openings that allow the steam to go through is disposed to place a foodstuff 19 on. Exciting coil 36 itself does not generate any heat; instead, the eddy current makes heating element 35 generate heat, to be conducted direct to the water. Thus, steam is produced efficiently.

According to a heating method with the above described constitution, water is heated only by a quantity for evaporation, which results in a limited consumption of water and almost instantaneous generation of steam at a small power consumption. Thus, the start and stop of heating may be executed instantaneously, which makes it possible to carry out an optimum control on the heating to be suitable to each of the heating/cooking stages. In this way, foodstuffs may be heated/cooked in a manner most suitable to respective category.

INDUSTRIAL APPLICABILITY

According to the present invention the environment within heating cavity such as temperature, humidity, etc. are controllable to fit a foodstuff; therefore varieties of foodstuffs may be heated/cooked to perfection. Namely, a microwave heating apparatus according to the present invention makes it possible to heat/cook maintaining the inner temperature and the surface temperature of a foodstuff almost identical.

Besides the heating/cooking of already described bread and frozen tempura, the present apparatus is ideal for such items wherein a plurality of foodstuffs are in one package and thawing or reheating of which is difficult with microwave alone, e.g. a box lunch, as well as for the refrigerator thawing where a frozen item is made to pass through the zone of maximum ice crystal formation and stopped at refrigerator temperature.

In addition to foodstuffs, a wide range of materials that have various dielectric loss may become the object of heating, in addition to foodstuffs. Various industrial fields where a delicate heat processing is required, for example, dissolving of synthetic resins, softening of glues, drying of woods, etc. will fall within the range of application.

Besides microwave, a high frequency alternating field may be employed as the heat source.

What is claimed is:

1. A microwave heating apparatus comprising:

a heating cavity for housing an object;

a microwave generating means for irradiating microwave energy to said object;

a steam generating means for supplying steam to said heating cavity; and a control means for controlling said microwave generating means and said steam generating means so that an inner temperature and a surface temperature of said object are made approximately equal and so that a temperature of an environment of the heating cavity is maintained at or slightly higher than the temperature of said object when said object reaches a desired appropriate temperature, wherein thermal and moisture exchange between said object and the environment of said heating cavity is minimized.

2. A microwave heating apparatus comprising:

a heating cavity for housing an object;

a microwave generating means for irradiating microwave energy to said object;

a steam generating means for supplying steam to said heating cavity;

a detection means for detecting environmental conditions within said heating cavity; and a control means for controlling said microwave generating means and said steam generating means in accordance with the output from said detection means so that an inner temperature and a surface temperature of said object are made approximately equal and so that a temperature of an environment of the heating cavity is maintained at or slightly higher than the temperature of said object when said object reaches a desired appropriate temperature, wherein thermal and moisture exchange between said object and the environment of said heating cavity is minimized.

3. The microwave heating apparatus as claimed in claim 2, wherein said detection means detects temperature.

4. The microwave heating apparatus as claimed in claim 2, wherein said detection means detects temperature and humidity.

5. The microwave heating apparatus as claimed in any one of claims 1 through 4, wherein, when heating said object in frozen state, said control means controls the output of said steam generating means after said object is thawed to be greater than the output of said steam generating means while said object is still in frozen state.

6. The microwave heating apparatus as claimed in any one of claims 1 through 4, wherein, when heating said object heating in frozen state, said control means controls the output of said microwave generating means after said object is thawed to be smaller than the output of said microwave generating means while said object is still in frozen state, and the output said steam generating means after said object of heating is thawed to be greater than the output of said steam generating means while said object is still in frozen state.

7. The microwave heating apparatus as claimed in any one of claims 1 through 4, wherein, when heating said object heating in frozen state, said control means controls the output of said microwave generating means immediately after start of to be smaller than the output of said steam generating means thereafter.

8. The microwave heating apparatus as claimed in any one of claims 1 through 4, wherein, when heating said object of heating in frozen state, said control means controls the output of microwave generating means to be gradually decreasing, and the output of steam generating means after the object of heating is thawed to be greater than the output of steam generating means while the object of heating is still in frozen state.

9. The microwave heating apparatus as claimed in any one of claims 1 through 4, wherein said control means reduces the output of said steam generating means at immediately before the end of heating object.

10. The microwave heating apparatus as claimed in any one of claims 1 through 4, wherein said control means controls the humidity within heating cavity to be lower than 90%.

11. A microwave heating apparatus comprising:

a heating cavity for housing an object;

a microwave generating means for irradiating microwave energy to said object;

a steam generating means for supplying steam to said heating cavity;

an air blowing means for supplying air flow to said object of heating; and a control means for controlling said microwave generating means and said steam generating means, and said air blowing means so that an inner temperature and a surface temperature of said object are made approximately equal and so that a temperature of an environment of the heating cavity is maintained at or slightly higher than the temperature of said object when said object reaches a desired appropriate temperature, wherein thermal and moisture exchange between said object and the environment of said heating cavity is minimized.

12. The microwave heating apparatus as claimed in claim 11, wherein said air blowing means takes the outside air into heating cavity.

13. The microwave heating apparatus as claimed in claim 11, wherein said air blowing means circulates the air within heating cavity.

14. The microwave heating apparatus as claimed in claim 11, wherein said control means makes said air blowing means keep on running for a specified time after output of microwave generating means is terminated.

15. The microwave heating apparatus as claimed in claim 11, wherein said control means makes said air blowing means keep on running intermittently for a specified time after output of microwave generating means is terminated.

16. A microwave heating apparatus comprising:

a heating cavity for housing an object;

a microwave generating means for irradiating microwave energy to said object;

a steam generating means for supplying steam to said heating cavity;

a heating means for preventing dew condensation in said heating cavity; and a control means for controlling said microwave generating means and said steam generating means so that an inner temperature and a surface temperature of said object are made approximately equal and so that a temperature of an environment of the heating cavity is maintained at or slightly higher than the temperature of said object when said object reaches a desired appropriate temperature, wherein thermal and moisture exchange between said object and the environment of said heating cavity is minimized.

17. The microwave heating apparatus as claimed in claim 16, wherein said heating means is disposed between steam generator and inside of said heating cavity.

18. The microwave heating apparatus as claimed in claim 16, wherein said heating means is disposed within said heating cavity.

* * * * *